US007798286B2

(12) United States Patent
Skowronski et al.

(10) Patent No.: US 7,798,286 B2
(45) Date of Patent: Sep. 21, 2010

(54) EXHAUST MUFFLER HAVING A HORIZONTALLY EXTENDING SOUND ATTENUATION CHAMBER

(75) Inventors: Keith Skowronski, Broadview Hts., OH (US); Mark Bockwich, Berea, OH (US); Ronald G. Huff, Westlake, OH (US)

(73) Assignee: TMG Performance Products, LLC, Wadsworth, OH (US)

( * ) Notice: Subject to any disclaimer, the term of this patent is extended or adjusted under 35 U.S.C. 154(b) by 0 days.

(21) Appl. No.: 12/217,856

(22) Filed: Jul. 9, 2008

(65) Prior Publication Data

US 2009/0014237 A1 Jan. 15, 2009

Related U.S. Application Data

(60) Provisional application No. 60/958,885, filed on Jul. 10, 2007.

(51) Int. Cl.
*F01N 1/02* (2006.01)
*F01N 1/08* (2006.01)
*F02M 35/12* (2006.01)

(52) U.S. Cl. ..... 181/266; 181/250; 181/276; 123/184.57; 60/312

(58) Field of Classification Search ..... 181/266, 181/250, 239, 251, 273, 276; 123/184.57; 60/312
See application file for complete search history.

(56) References Cited

U.S. PATENT DOCUMENTS 2,014,666 A * 9/1935 Peik ..... 181/252
2,075,265 A * 3/1937 Bourne ..... 181/273
2,103,810 A * 12/1937 Eduard ..... 181/273
2,139,151 A * 12/1938 Deremer ..... 181/250
2,297,046 A * 9/1942 Bourne ..... 181/250
3,263,772 A * 8/1966 Irwin et al. ..... 181/227
3,648,803 A * 3/1972 Heath et al. ..... 181/250

(Continued)

FOREIGN PATENT DOCUMENTS

JP 62-126215 6/1987

(Continued)

OTHER PUBLICATIONS

International Search Report dated Oct. 22, 2008 (Application No. PCT/US2008/008505; filed Jul. 9, 2008).

(Continued)

*Primary Examiner*—Edgardo San Martin
(74) *Attorney, Agent, or Firm*—Rankin, Hill & Clark LLP

(57) ABSTRACT

A muffler for reducing the sounds of combustion gases exhausted from an internal combustion engine. The muffler including an elongated fluid passage extending between an inlet and an outlet such that the outlet is in fluid communication with the inlet. The inlet of the muffler being connectable with the gases exhausted from the engine and the outlet being connectable with the atmosphere. The passage having a first side region and a second side region circumferentially spaced from the first region with a fluid passage in at least one of the first and second side regions. The muffler further including a side attenuation sound chamber adjacent the at least one of the side regions wherein the chamber is circumferentially spaced from the other of the at least one side region.

32 Claims, 12 Drawing Sheets

U.S. PATENT DOCUMENTS

| | | | | | |
|---|---|---|---|---|---|
| 3,655,011 | A | * | 4/1972 | Willett | 181/228 |
| 3,680,660 | A | * | 8/1972 | DuBois | 181/250 |
| 3,685,616 | A | * | 8/1972 | Malkiewicz | 181/266 |
| 4,006,793 | A | | 2/1977 | Robinson | |
| 4,821,840 | A | * | 4/1989 | Harwood et al. | 181/282 |
| 5,129,793 | A | | 7/1992 | Blass et al. | |
| 5,283,398 | A | * | 2/1994 | Kotera et al. | 181/224 |
| 5,350,888 | A | | 9/1994 | Sager, Jr. et al. | |
| 5,502,283 | A | | 3/1996 | Ukai et al. | |
| 5,659,158 | A | | 8/1997 | Browning et al. | |
| 5,708,237 | A | | 1/1998 | Maeda et al. | |
| 5,783,780 | A | * | 7/1998 | Watanabe et al. | 181/229 |
| 5,952,625 | A | | 9/1999 | Huff | |
| 6,199,658 | B1 | | 3/2001 | Huff | |
| 6,508,331 | B1 | * | 1/2003 | Stuart | 181/250 |
| 6,595,319 | B1 | | 7/2003 | Huff | |
| 7,281,605 | B2 | * | 10/2007 | Huff et al. | 181/250 |
| 7,588,424 | B2 | * | 9/2009 | Mrzyglod | 181/268 |
| 7,610,993 | B2 | * | 11/2009 | Sullivan | 181/268 |

FOREIGN PATENT DOCUMENTS

| | | | | |
|---|---|---|---|---|
| JP | 62126215 | A | * | 6/1987 |

OTHER PUBLICATIONS

International Preliminary Report on Patentability, dated Jan. 12, 2010 in connection with PCT/US2008/008505, filed Jul. 9, 2008.

* cited by examiner

EXHAUST MUFFLER HAVING A HORIZONTALLY EXTENDING SOUND ATTENUATION CHAMBER

This invention relates generally to mufflers of the sound modifying type used with internal combustion engines to attenuate engine noise and more particularly to mufflers conventionally referred to as side branch mufflers. This application claims priority in Provisional Patent Application Ser. No. 60/958,885 that was filed on Jul. 10, 2007 which is incorporated by reference herein.

The invention is particularly applicable to and will be described with specific reference to a straight through muffler for use in sports cars or high performance automotive vehicles. However, as will be appreciated by those skilled in the art that the inventive concepts disclosed herein may be utilized for any number of muffler applications and in combination with or as part of other muffler systems or concepts for attenuating a specific or a specific range of sound waves.

INCORPORATION BY REFERENCE

The following patents are incorporated by reference as indicative of the muffler art so that details known to those skilled in the art need not be repeated herein:

A) U.S. Pat. No. 5,659,158 to Browning et al., entitled "Sound Attenuating Device and Insert", issued Aug. 19, 1997;

B) U.S. Pat. No. 5,502,283 to Ukai et al., entitled "Muffler", issued Mar. 26, 1996;

C) U.S. Pat. No. 5,350,888 to Sager, Jr. et al., entitled "Broad Band Low Frequency Passive Muffler", issued Sep. 27, 1994;

D) U.S. Pat. No. 5,129,793 to Blass et al., entitled "Suction Muffler", issued Jul. 14, 1992; and, E) U.S. Pat. No. 4,006,793 to Robinson, entitled "Engine Muffler Apparatus Providing Acoustic Silencer" issued Feb. 8, 1977.

F) U.S. Pat. No. 6,595,319 to Huff, entitled "Muffler" issued Jul. 22, 2003.

G) U.S. Pat. No. 6,199,658 to Huff, entitled "Multi-Fold side branch muffler" issued Mar. 13, 2001.

H) U.S. Pat. No. 5,952,625 to Huff, entitled "Multi-Fold side branch muffler" issued Sep. 14, 1999.

BACKGROUND OF THE INVENTION

Engine noise in an internal combustion engine typically is generated by the sudden expansion of combustion chamber exhaust gases. As the combustion gases are exhausted from each cylinder of the engine, a sound wave front travels at rapid sonic velocities through the exhaust system. This wave front is the boundary between the high pressure exhaust pulse and ambient pressure. When the sound wave front exits the exhaust system, it continues to pass through the air until three dimensional diffusion causes it to eventually dissipate. As the wave front passes an object, an overpressure is created at the surface of the object, and it is this overpressure that is a direct cause of audible and objectionable noise.

Since the inception of the internal combustion engine, efforts have been underway to reduce or muffle the noise caused by the engine. Obviously, considerable noise attenuation or reduction can be achieved in a muffler having dimensions that are large enough to permit three dimensional dissipation of the sound waves within the muffler housing. However, from a practical standpoint, design criteria often dictate the size of the muffler which must be kept as small as possible. Further means of reducing engine noise include the use of packing and complex baffle systems. However, these approaches are often accompanied by a substantial increase in the back pressure or resistance of the muffler to the free discharge of the combustion gasses. The increase in backpressure can result in a decrease in the output horsepower of the engine with a resulting loss of efficiency in fuel economy.

Mufflers are classified in various manners within the art. From a structural consideration, mufflers have been classified as being either of two basic types or configurations:

i) a compartmentalized type which comprises several compartments sealed except for the inlets and outlets, the compartments usually being sealed, noise entrapment chambers; or, ii) a type commonly known as a straight through muffler which usually comprises a duct having a series of perforations within a sealed housing.

In accordance with this classification, this invention is particularly adaptable to mufflers of the straight through type although, it could have application to compartmentalized type mufflers.

From a functional view, mufflers may be classified as dissipative or reactive. Dissipative mufflers are typically composed of ducts or chambers filled with acoustic absorbing materials such as fibre glass, steel wool or even porous ceramics. Such materials absorb acoustic energy and transform it into thermal energy. Reactive mufflers, on the other hand, are composed of a number of inner connected chambers of various sizes and shapes in which sound waves are reflected to dampen or attenuate waves of a set frequency, typically resonance frequency. This invention relates more to a reactive type muffler.

There are two types of reaction mufflers, a side branch type muffler and a resonator type muffler. A resonator type muffler uses various volumes of different shapes or sizes, i.e., resonance chambers, interconnected with pipes and can dampen not only resonance frequency but also sound waves having frequencies near the resonance frequency. The drawback to resonator mufflers is the large volume required to dampen low frequency sound waves.

The side branch muffler is the type of muffler to which this invention relates. Generally, the side branch muffler has a straight through pipe and an offset or a side branching off the straight through pipe. The side branch is closed at its end and may be bent or shaped with baffles as shown in some of the patents incorporated by reference herein. When the sound wave reaches the closed end of the side branch, it reflects back towards the open end damping waves at the same frequency and out of phase with the reflected wave. The side branch muffler possesses an advantage over the resonator type muffler in that a large volume is not required to dampen any sound wave of a given frequency. However, low frequency sound waves which produce the most objectionable noise require long, side branch lengths which make it difficult to fit within the confines of certain automotive applications.

Apart from the functional and structural discussion above, sports cars and high performance vehicles have additional requirements. It has long been known that the exhaust systems of such vehicles must be tuned to emit certain sounds from the automobile which appeal to the purchaser of such vehicles while satisfying noise regulations. Such applications require attenuation of specific waves having set frequencies to produce the desired sound. More particularly, high performance mufflers of the type under discussion are tuned to the specific type of engine to which the muffler will be applied to. Specifically, the valving or breathing characteristics of the engine are matched to the muffler over the operating range of the engine to produce the desired tone. Recent engineering advances in the structural rigidity of the body or chassis of the vehicle in which the engine is mounted have enhanced the sound of the engine within the cabin of the vehicle. Specifically, a muffler could be tuned to a desired sound with the engine on a test stand, but produce objectionable resonance in the cabin. Since the cabin cannot be dampened, the muffler has to be precisely tuned to attenuate the sound waves producing the objectionable resonance within the cabin.

The side branch type muffler, in theory, has the ability to resolve this problem. However, the approach followed was random and haphazard and simply involved reconstructing entirely different side branch designs until one resulted in the removal of the objectionable noise. Unfortunately, the length of the side branch typically exceeded the space limitations for the muffler design.

The Huff patents above (U.S. Pat. Nos. 6,595,319; 6,199,658; and 5,952,625) overcame many of these problems with a side branch type muffler which can be readily tuned to produce any desired sound in a compact design avoiding the space limitations afflicting conventional side type mufflers. In this respect, the Huff patents show a muffler with an inner cylindrical casing axially extending from the inlet through the outlet and defining an open ended inner chamber contained therein through which the exhaust gases pass. An outer concentric casing with axial end sections is spaced radially outward from the inner casing and defines therebetween a closed end outer chamber. A slotted opening arrangement at a set axial position provides fluid communication between the inner and outer chamber. A sound attenuating arrangement within the outer chamber includes a plurality of intermediate, cylindrical casings which axially extend substantially the length of the outer chamber and are radially spaced to overlie one another so that each pair of radially adjacent casings forms an annular, axially extending sound attenuation passage. Each sound passage has an entrance in fluid communication with a pressure wave at one end thereof and a sound reflection wall at its opposite end to establish a second path therebetween. Certain select sound passages have an entrance in fluid communication with the slotted opening while other sound passages have an entrance in fluid communication with an adjacent sound passage whereby a plurality of sound passages having various sound path lengths is produced for reflecting and attenuating a plurality of sound waves at set frequencies, particularly sound waves of low frequency. It was found that this muffler configuration is effective in eliminating objectionable sounds.

Further, the Huff muffler can be modified to include at least one annular stop plate extending within a selected sound passage between radially adjacent intermediate casings forming the selected sound passage. The stop plate is positioned at a set axial distance within the selected sound passage correlated to the axial distance a sound wave travels from a passage entrance to the stop plate whereby any sound wave of any specific frequency may be attenuated by positioning the stop plate at a set axial distance in a sound passage thus permitting the muffler to be tuned to any desired sound.

However, while the Huff muffler is effective, it is limited in its application due to the size of the radially spaced sound passages. In this respect, the radially spaced sound passage produce a muffler that is cylindrical with a side dimension equal to the height dimension. Many applications have different height and width requirement wherein the cylindrical configuration exceeds one of these dimensional limitations. Further, additional sound chambers, to attenuate multiple frequencies, increase the length of the muffler wherein it can be too long for certain vehicles. The Huff mufflers also can be costly to manufacture in that they require successively decreasing radial height for each successively larger diameter sound passages of the outer passages to avoid pressure undulations and accompanying sound wave variations as the waves travel in a sound path from one sound passage to another radially spaced sound passage.

SUMMARY OF THE INVENTION

In accordance with the present invention, provided is a side branch type muffler which can be readily tuned to produce any desired sound in a subcompact and lightweight design allowing use in virtually all types of vehicles. More particularly, provided is a muffler design that is shorter in both overall height and overall length than prior art mufflers even though the same sound reflection is achieved.

In this respect, a muffler according to the present invention includes an elongated fluid passage extending between an inlet and an outlet such that the outlet is in fluid communication with the inlet. Further, the inlet can be configured to be connectable with the gases exhausted from the engine and the outlet configured to be in fluid connection atmosphere. The passage has a first side region and a second side region that is circumferentially spaced from the first region wherein a fluid passage is positioned in at least one of the first and second side regions. The muffler further includes a side attenuation sound chamber adjacent the at least one of the side regions such that the chamber is circumferentially spaced from the other of the at least one side region. This configuration produces a muffler that has a width that is greater than the height (or visa versa) such that the smaller height dimension allows use of this muffler in vehicles with certain size constraints.

A muffler according to another aspect of the present invention can include an elongated fluid passage with a first fluid passage in the first region and a second fluid passage in the second region. Further, the muffler can include a first side attenuation sound chamber adjacent the first region and in fluid connection with the first passage and a second side attenuation chamber adjacent the second region and in fluid connection with the second fluid passage. In this embodiment, the second chamber is circumferentially spaced from the first chamber wherein a greater range of sound can be attenuated without increasing the overall height or length of the muffler.

A muffler according to yet another aspect of the present invention can include a first side attenuation sound chamber in fluid connection with the first fluid passage having an inner side that is adjacent one of the side regions and an outer side opposite to and radially spaced from the inner side with a second side attenuation chamber in fluid connection with the second fluid passage wherein the second chamber is adjacent to the outer side of the first chamber.

A muffler according to a further aspect of the present invention can include a fluid passage in at least one of the first and second side regions and a side attenuation sound chamber adjacent to the at least one of the side regions. The muffler can further include a dissipation sound chamber in fluid connection with the same elongated fluid passage.

A muffler according to yet a further aspect of the present invention can include a fluid passage in at least one of the first and second side regions with a side attenuation sound chamber adjacent the at least one of the side regions such that the chamber is circumferentially spaced from the other of the at least one side region. The muffler can further include a dissipation sound chamber in fluid connection with the elongated fluid passage such that the dissipation sound chamber extends about the side attenuation chamber and a portion of the elongated passage.

A muffler combination according to the present invention can also include one or more combinations of the features above and/or one or more features found in prior art mufflers including, but not limited to, features found in tank mufflers and/or other dissipation style mufflers.

These and other objects, features and advantages of the invention will become apparent to those skilled in the art upon a reading of the Detailed Description of the invention set forth below taken together with the drawings which be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE INVENTION

Figure 1:
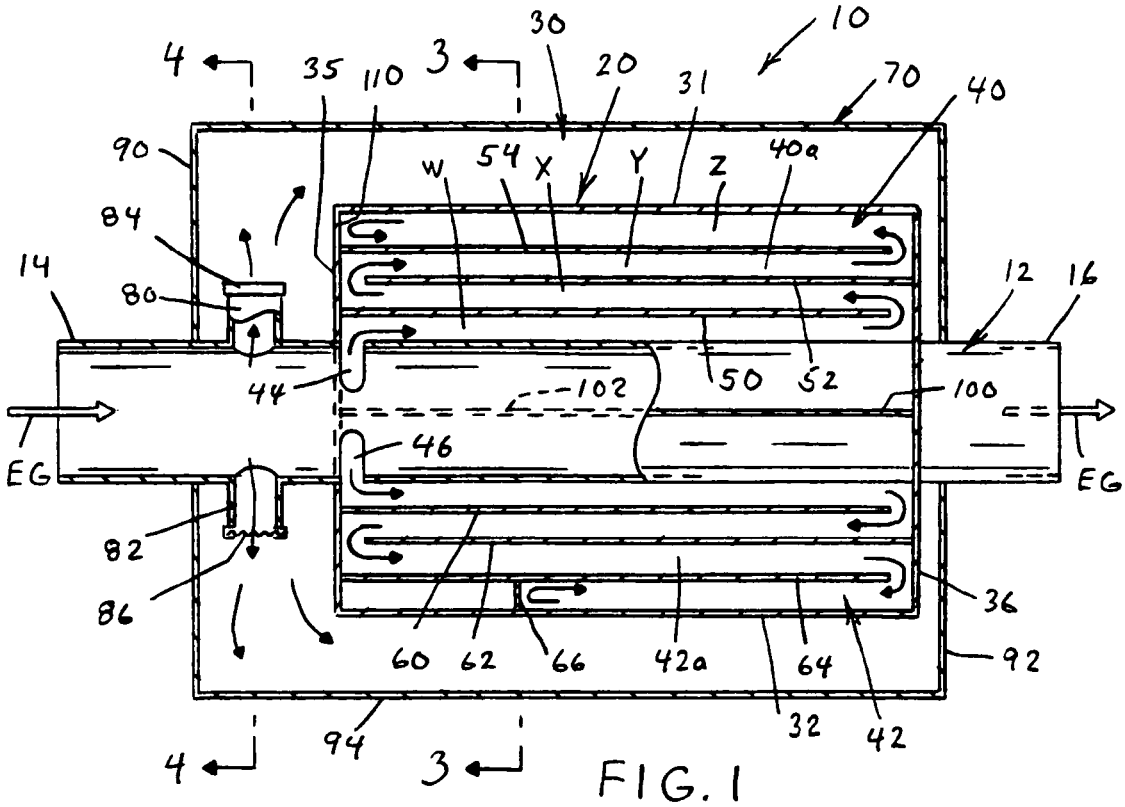
FIG. 1 is a top sectional view of one embodiment of the present invention which includes both dual inner sound chambers and an outer sound chamber.
Figure 2:
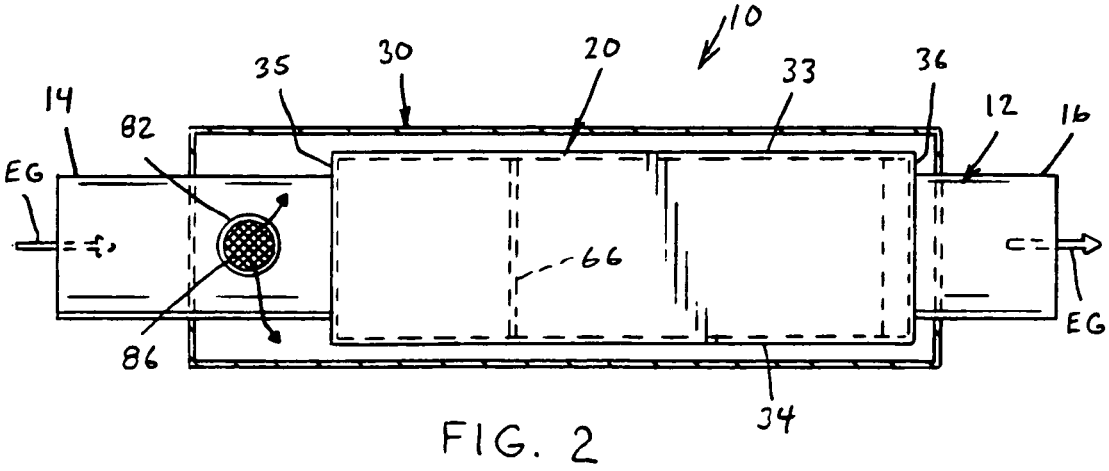
FIG. 2 is a side view, partially in section, of the muffler shown in FIG. 1.
Figure 3:
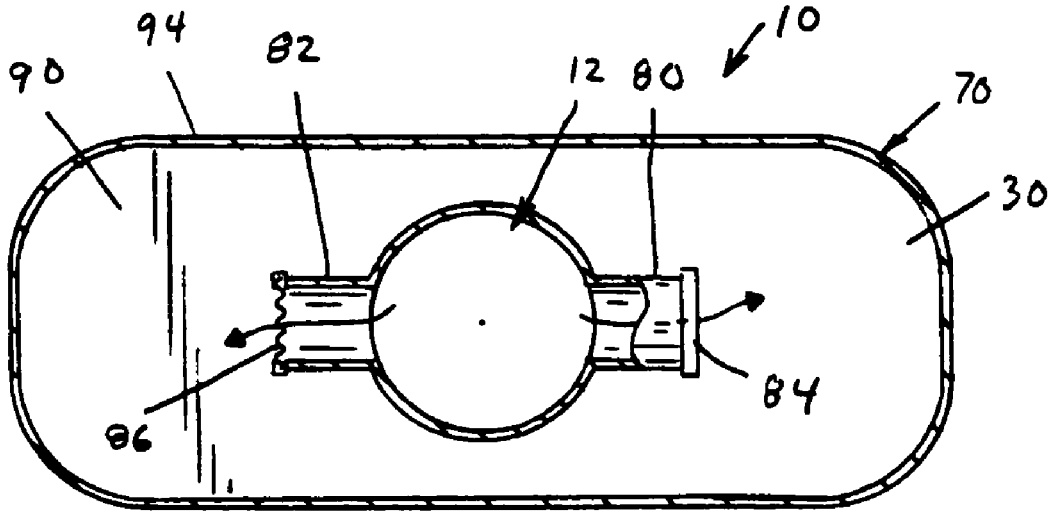
FIG. 3 is a sectional view taken along lines 3-3 in FIG. 1.

Referring now to the drawings wherein the showings are for the purpose of illustrating preferred and alternative embodiments of the invention only and not for the purpose of limiting same, there is shown in FIGS. 1-4 a muffler 10 illustrating at least one embodiment of the present invention.

Muffler 10 has an inner, axially extending through pipe or passage 12 which can be tubular, as is shown, and includes an inlet 14 and an outlet 16 wherein the exhaust of an internal combustion engine flows through muffler 10 from inlet 14 to outlet 16. Muffler 10 further includes an inner sound vessel 20 and an outer sound chamber 30. The arrows in FIG. 1, and in other Figures in this specification, generally show the flow of exhaust gases but, are illustrated in nature only in that they are intended to generally show the gas flow and/or sound pulse flow through the sound chambers at a given time and they do not show all flow patterns within muffler 10.

Turning to inner vessel 20, included is a box structure having side walls 31 and 32 extending parallel to one another; a top wall 33 and a bottom wall 34 extending parallel to one another wherein walls 31-34 extend between end plates 35 and 36. Vessel 20, in this embodiment, includes a first inner sound chamber 40 having a sound passage 40*a* and a second inner sound chamber 42 having a sound passage 42*a*. The exhaust gases, EG, that flow into muffler 10, are directed to the first chamber by a sound attenuation opening, opening as slot 44. Sound chamber 40 includes dividers or partitions 50, 52 and 54 to extend the length of the sound passage 40*a* which will be discussed in greater detail below. As can be appreciated, more than or less than three partitions can be utilized without detracting from the invention of this application. As will be discussed in greater detail below, the number of partitions are a function of the length of the inner vessel along with the wavelength and/or frequency of the sound wave to be attenuated. In this particular embodiment, sound chamber 42 includes a similar configuration as sound chamber 40 wherein it includes three partitions or dividers 60, 62 and 64. However, chamber 42 further includes a stop plate 66 such that passage 42*a* is shorter than passage 40*a* to attenuate a different sound wave. In view of the two different inner lengths, a wider range of frequencies can be attenuated by inner vessel 20.

With respect to outer sound chamber 30, this chamber can be formed by an outer housing 70 and the outer walls of inner vessel 20. As with all embodiments of this application which include functional outer housings, a wide range of sound reducing arrangements can be utilized in outer sound chamber 30 formed by the housing. These can include methods known in the art such as compartmentalized systems and dissipation systems. For example, outer sound chamber 30 could include acoustic absorbing material packed in housing 70 where the material can be fiberglass material configured to further deaden sound and/or reduce a particular frequency of sound produced by the internal combustion engine.

Chamber 30 can include a first inlet tube 80 and a second inlet tube 82. While two inlet tubes are shown, more or less inlet tubes can be utilized in connection with the outer sound chamber based on the technology used in the chamber and the particular frequency to be deadened. Further, while cylindrical inlet tubes are shown, other tube configurations can be utilized without detracting from the invention of this application. Tubes 80, 82 can further include mesh outlets 84 and 86, respectively. The combination of the tube diameter, length and the hole size of the mesh outlet can be utilized to control the flow of exhaust gas EG into the outer sound chamber. In addition, inlet tubes 80 and 82 are shown near inlet 14 of the muffler, these tubes can be positioned anywhere along through pipe 12. For example, tubes 80 and 82 can be positioned near outlet 16 downstream of inner vessel 20.

Housing 70 can be constructed as is known in the art including being constructed with end plates 90, 92 and a side wall 94 extending between the end plates. Housing 70 also generally fixes the position of the inlet 14 and the outlet 16 of through pipe 12 and can function as a support for the brackets and the like, if needed, for securing muffler 10 within the vehicle's exhaust system. However, it is also possible to eliminate outer housing 70 and utilize the outer box structure of inner vessel 20 to mount muffler 10 to the exhaust system of the vehicle. Further, the materials utilized to produce both the inner and outer chamber can be those known in the art of sufficient strength to support the muffler within the system and produce a muffler of sufficient integrity to have a long service life. These materials can include, but are not limited to, stainless steels that are known in the art to produce a long service life.

As is discussed above, the fluid connection between through pipes 12 and chamber 40 is via slot 44. While it is shown as being a single slot, multiple slots could be utilized to provide the fluid connection between the through pipe and the chamber. The area of opening or slot 44 should be similar to the cross-sectional area of the flow path 40*a* within sound chamber 40 such that the wave that travels through chamber 40 is not dispersed and is maintained as a unified wave. However, the slot producing the fluid connection can be a different area but should be at least 70% of the through pipe flow area within the flow path of the respective chamber to maximize the sound attenuation. Similarly, opening or slot 46 should also be configured to have a similar area as the cross-sectional flow path 42*a* found in chamber 42. Chambers 40 and 42 can be separate chambers that are separated by ribs 100 and 102 that are affixed to through pipe 12 and the housing of inner vessel 20. As will be discussed in relation to embodiments below, the system can include a cross-over arrangement wherein there is at least one gap in at least one of these ribs. As is discussed above, chamber 42 includes end plate 66 which produces a different length in the sound passage found in chamber 42 thereby providing sound attenuation for a different frequency wave form.

Figure 4:
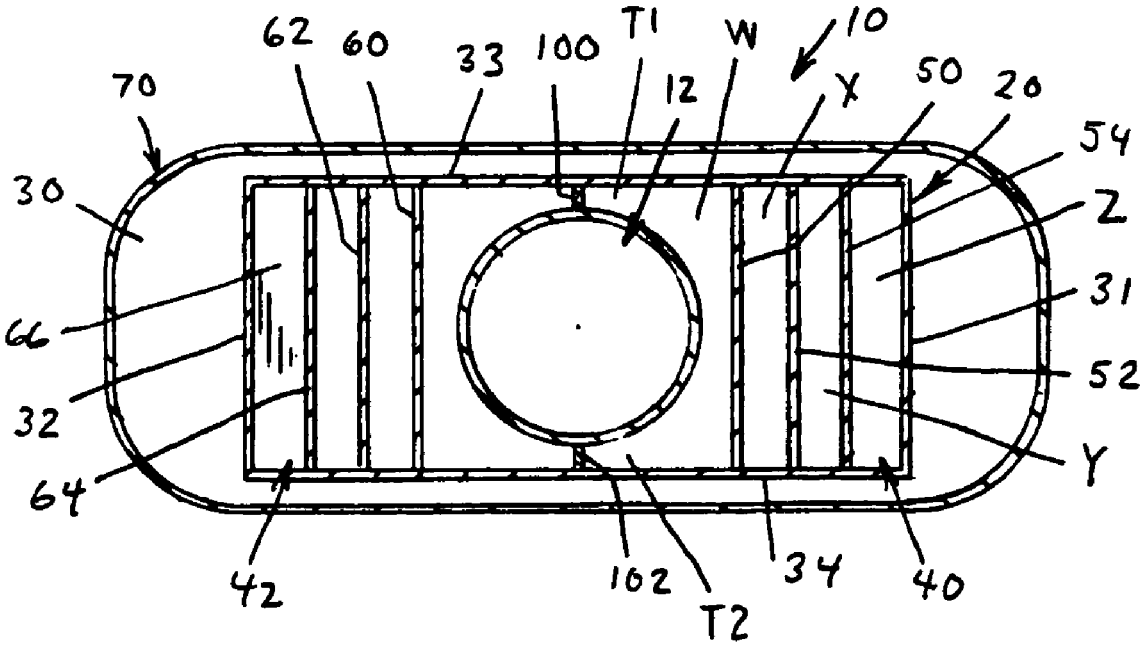
FIG. 4 is a sectional view taken along lines 4-4 in FIG. 1.

With special reference to FIG. 4, the acoustic wave flow path areas of this embodiment and other embodiments in this application influence the sound attenuation of the particular sound chamber. In this respect, the cross-sectional area of the sound wave flow path will determine, at least in part, the amount of acoustic power that will flow through a given wave path. As can be appreciated, the larger the area, the higher the efficiency of the system due to partial attenuation in the sound path. As a result of this partial attenuation, the returning sound wave will include less energy and will have a smaller cancelling effect on the subsequent sound wave. Further, the configuration or cross-sectional shape can also impact the efficiency of the sound chamber. Nonetheless, even though the cross-sectional area in this application is discussed to be uniform, it is not necessary that the cross-sectional area be exactly uniform. As can be appreciated, manufacturing tolerances will create differences in the area since it is difficult and expensive to produce true uniform configurations. Further, other factors such as flow path configurations may dictate that a different dimensional area is necessary to achieve the desired flow. Thus, while the dimensional cross-sectional area may vary, a uniform "effective" cross-sectional area may be achieved such that there is uniform flow characteristic even if the configuration of the flow path changes along the path. A good example of this is shown in FIG. 4 wherein flow path sections W-Z have corresponding cross-sectional areas A1-A4 that have a generally uniform "effective" cross-sectional area. However, section W has a larger dimensional cross-sectional area than sections X-Z which can produce a loss of efficiency due to partial attenuation. In this respect, section W has a cross-sectional configuration that is partially formed by passage pipe 12. However, even with this loss of efficiency, the sound chamber can be adjusted to attenuate substantial sound waves.

With respect to FIGS. 1-4, exhaust gases EG from the internal combustion engine are exhausted as pulses of gas under pressure determined by the engine's timing control and the opening and closing of intake and exhaust valves. The pressure pulse produced by the gases exhausted through the exhaust valves carries a wave front which travels through the exhaust system and dissipates in three dimensional expansion. Whenever an obstruction is encountered by the pulse wave, sound waves having a frequency spectrum or a wide range of frequencies will be transmitted, reflected or absorbed.

When the exhaust gases travel through pipe 12, they will first encounter tubes 80, 82 and then slots 44 and 46 wherein they will be in fluid connection with the pressurized sound passage chambers 30, 40 and 42, respectively. These are pressurized chambers since they are closed. When the sound waves meet these obstructions, the sound wave will travel through the tubes and the slots into the respective sound passages.

With respect to sound passage 40, the sound wave will travel through the sound passages until it meets stop plate or end wall 110 and it will then be reversed in direction and travel and then exit back through slot 44. Similarly, the sound wave entering slot 46 of sound chamber 42 will travel through the sound chamber until it engages end plate 66 wherein it will be reversed and pass back through the sound chamber until it exits slot 46. With respect to sound chamber 30, the wave will enter the sound chamber through multiple openings and will travel through this chamber dependent on the sound dissipating method that is used therein. As is discussed above, this can be sound attenuation and also could be sound dissipation through means such as glass fill packing.

With respect to the sound attenuation of chambers 40 and 42, and possibly chamber 30, the reversing sound wave that exits the sound chamber will cancel at least a portion of a subsequent sound wave travelling through the muffler system. This has been found to greatly reduce the sound produced by an internal combustion engine. However, the frequency of the sound that is reduced is limited wherein the use of multiple sound chambers can be utilized to reduce the sound waves of a greater range of frequencies.

While slots 44 and 46 are shown to be positioned in sound vessel 20 nearest inlet 14, the location of the slots can be positioned anywhere along the through pipe within the sound chamber. As can be appreciated, this could be utilized to further change the length of the respective sound passageway based on the frequency of wave to be attenuated. Further, slots 44, 46 do not need to be adjacent one another.

As is known, the frequency or period of this sinusoidal sound curve is a function of the admitted sound. High pitched sounds have waves with short periods and high frequencies and low pitched sounds have long periods and low frequencies. Low pitched exhaust sounds are typically those which are objectionable. When the sound wave travels through a sound passage such as 40*a* and 42*a* and strikes the stop plate sections 110 and 66 respectively, it is reversed. More particularly, the sound wave is reflected back by these stop plates and if the axial length of passages 40*a* and/or 42*a* is matched to the quarter period of a given sound wave (i.e., period× speed=distance) it becomes possible to produce a reflective sound wave which has its phase shifted 180°. The reflected sound wave thus cancels out or attenuates or dampens an incoming sound wave in through pipe 12. Assuming that the sound wave was perfectly attenuated by the reflected wave, the wave would be cancelled. However, because of the presence of harmonics, the reflecting wave can never totally cancel or mute the incoming sound wave. However, the largest order of sound magnitude can be cancelled. Generally speaking, the energy or amplitude of these waves is less than the attenuated sound waves and, thus, the noise is reduced.

With respect to muffler 10, three ranges of frequencies can be attenuated by this muffler arrangement and it is more compact than the muffler arrangements in the past. In this respect, the first and second sound chambers can be positioned parallel to one another instead of axially spaced from one another which greatly reduces the axial length of the combined sound chambers. In addition, since the sound chambers are parallely spaced on either side of through pipe 12, the overall height of the flow chambers can be reduced. As a result of this configuration, both the length and the height of the muffler arrangement can be greatly reduced without affecting the performance of the muffler system. Yet even further, simplified manufacturing techniques can be utilized wherein the spacing of the dividers 50, 52, 54, 60, 62 and 64 can be maintained by the interengagement between the edges of these plates and the outer housing of the inner sound vessel. Spacers are not necessary to maintain proper gap and structural integrity of these sound passages within these chambers. Overall, the same performance can be produced by a muffler system having reduced parts and, therefore, reduced weight.

Figure 5:
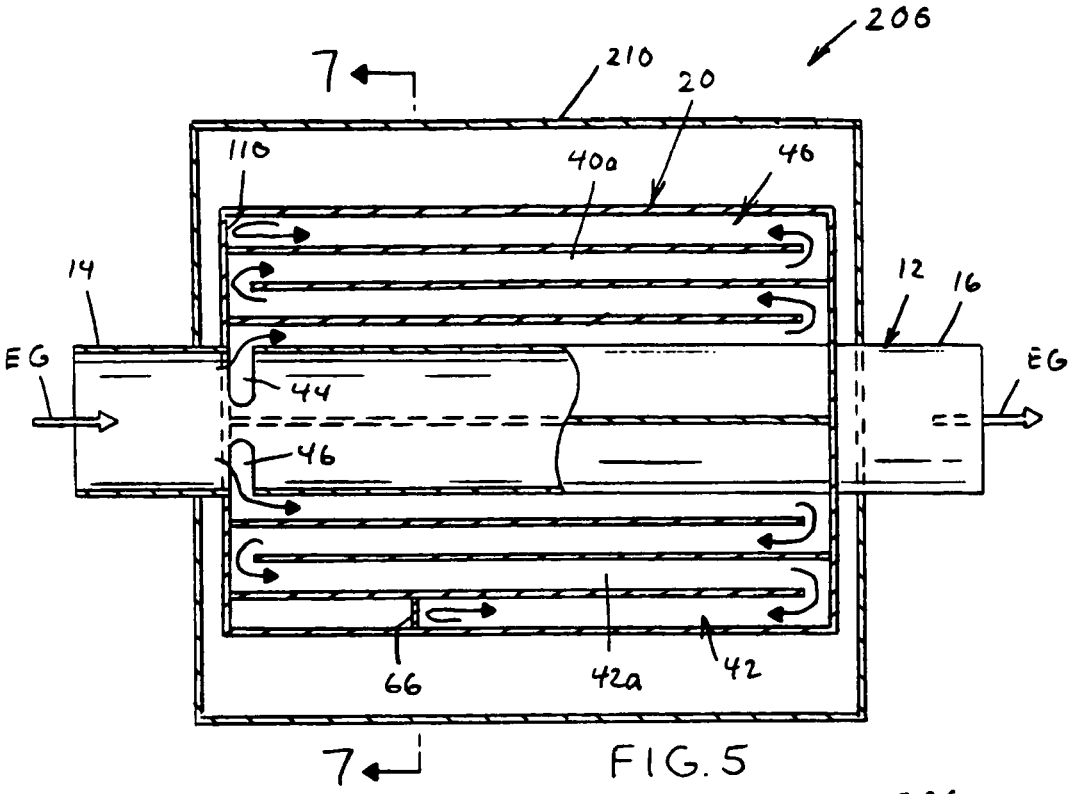
FIG. 5 is a top sectional view of another embodiment of the muffler of the present invention which does not include an outer sound chamber.
Figure 6:
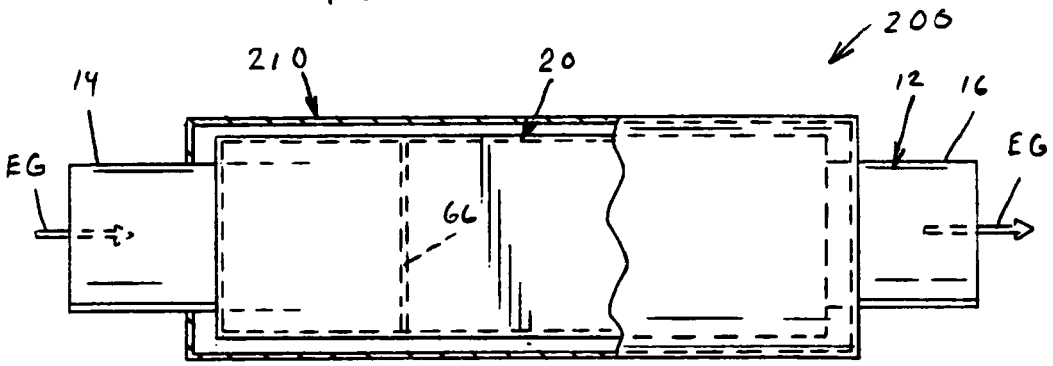
FIG. 6 is a side view, partially in section, of the muffler shown in FIG. 5.
Figure 7:
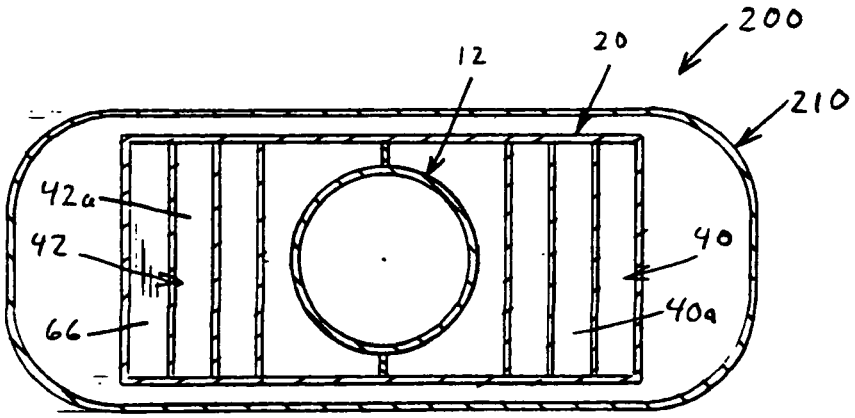
FIG. 7 is a sectional view taken along lines 7-7 in FIG. 5.
Figure 8A:
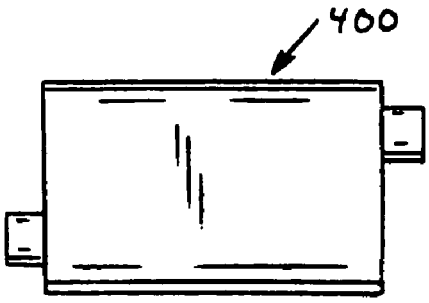
FIGS. 8*a*-8*e* are several top views of the overall outer configurations of mufflers according to the present invention.
Figure 8B:
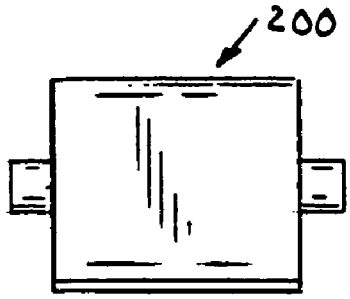
Figure 8C:
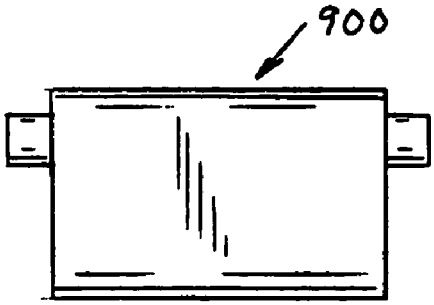
Figure 8D:
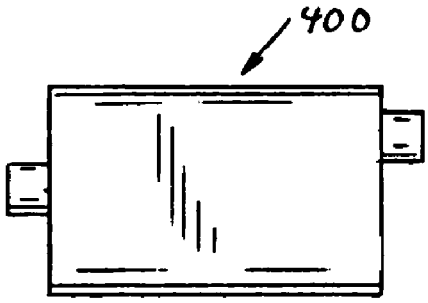
Figure 8E:
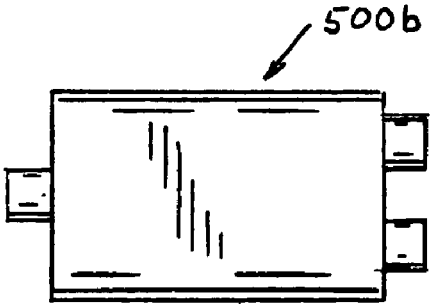

With reference to FIGS. 5-7, shown is a muffler 200 which includes inner sound chambers that can be the same or similar to muffler 10 described above. However, muffler 200 does not include an outer sound chamber. As can be appreciated, based on the sound to be dampened, a muffler according to the present invention can be limited to inner sound chambers that attenuate the sound waves produced by the internal combustion engine. In this particular embodiment, housing 210 is primarily structural and can be used to help secure muffler 200 within the exhaust system. Since the configurations of chambers 40 and 42 are discussed above, they will not be discussed with respect to this embodiment. Further, it should be noted that different length chambers could be used for sound chambers 40 and/or 42 in this embodiment and others without detracting from the invention of this application. Further, length and width limitations can be addressed by adding and/or removing partitions.

As can be appreciated, since the muffler does not include an outer sound chamber, housing 210 can be eliminated in one embodiment. While the outer housing can be utilized to further deaden sound and/or to provide a structural outer layer, the present invention can be formed by an inner vessel that can be structurally designed to support the vessel to the vehicle exhaust system. Further, while not shown, the outer layer can be formed in other configurations such as an enlarged rectangular configuration similar to the outer walls of inner vessel 20. Since the sound attenuation of this embodiment is similar to those in embodiments discussed above, the particulars will not be discussed in connection with this embodiment. However, as can be appreciated, one or more of the attenuation configurations described above or below can be utilized in this muffler arrangement wherein the housing is integral with the sound vessel.

With reference to FIGS. 8*a*-8*e*, shown are some of the many muffler configurations that are possible with the side branch muffler design of this application which were not possible utilizing prior art techniques of sound attenuation. Some of these other configurations will be discussed in greater detail below.

Figure 9:
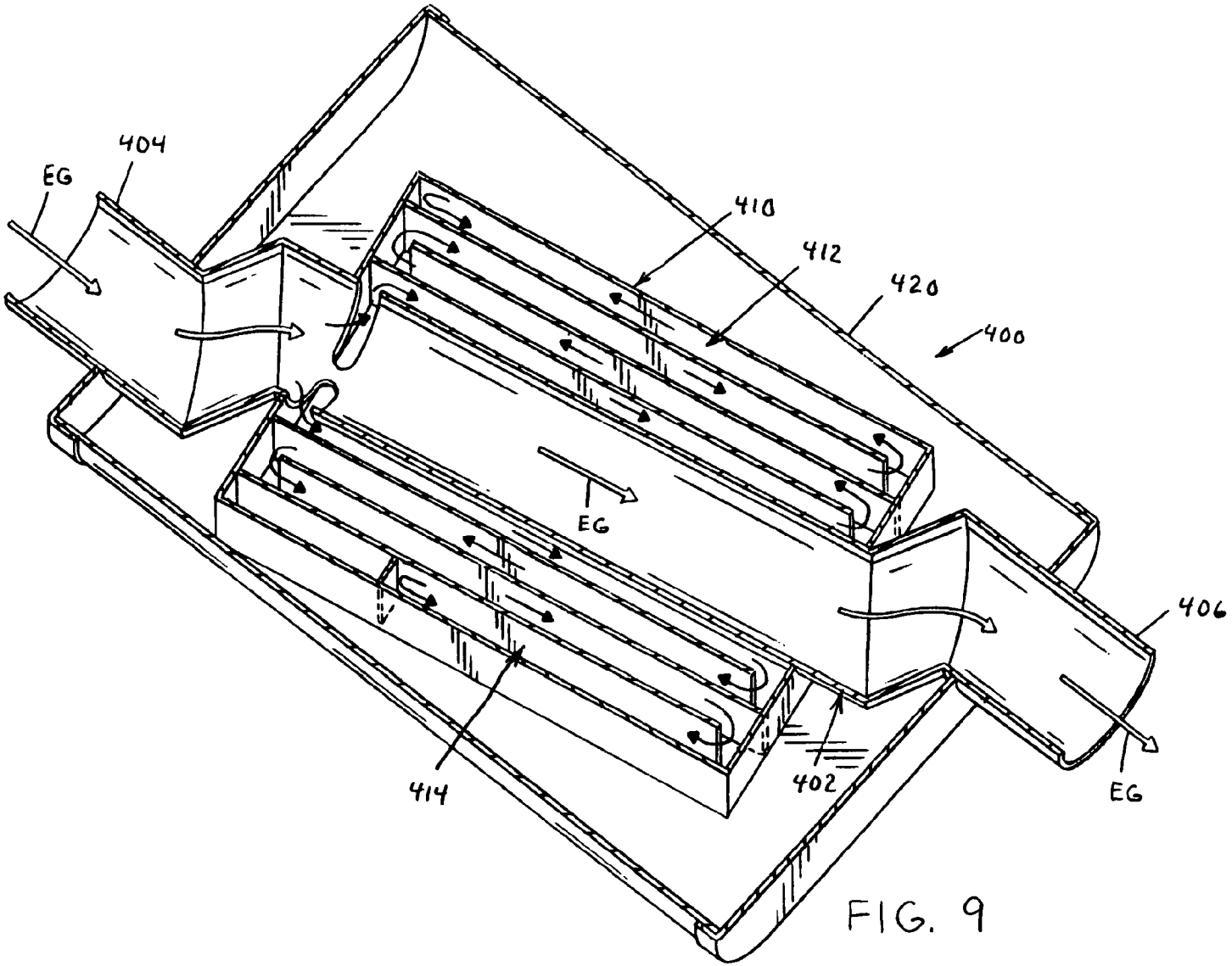
FIG. 9 is a perspective view, in section, of yet another embodiment of the present invention including a differently configured inner sound vessel wherein the inlet pipe is offset from the outlet.

FIG. 9 shows a muffler 400 having an offset through pipe 402 with an inlet 404 and an outlet 406. Muffler 400 further includes an inner sound vessel 410 that includes sound chambers 412 and 414. Inner sound vessel 410 is surrounded, in this embodiment, by an outer housing 420 that is not in fluid connection with exhaust EG. As with other embodiments, housing 420 can include mounting structures to secure muffler 400 in proper position on a vehicle of choice. The offset configuration of through pipe allows muffler to have an offset configuration design for certain vehicles needing an offset muffler. As a result, sound chambers 412 and 414 of inner sound chamber 410 are angled relative to housing 420. The sound attenuation of muffler 400 functions similar to those discussed above and; therefore, will not be discussed in detail. Further, while not shown, this sound configuration can have other arrangement discussed in this application including, but not limited to, an outer housing in fluid communication with passage 402 wherein housing can be a "functional" housing.

Figure 10A:
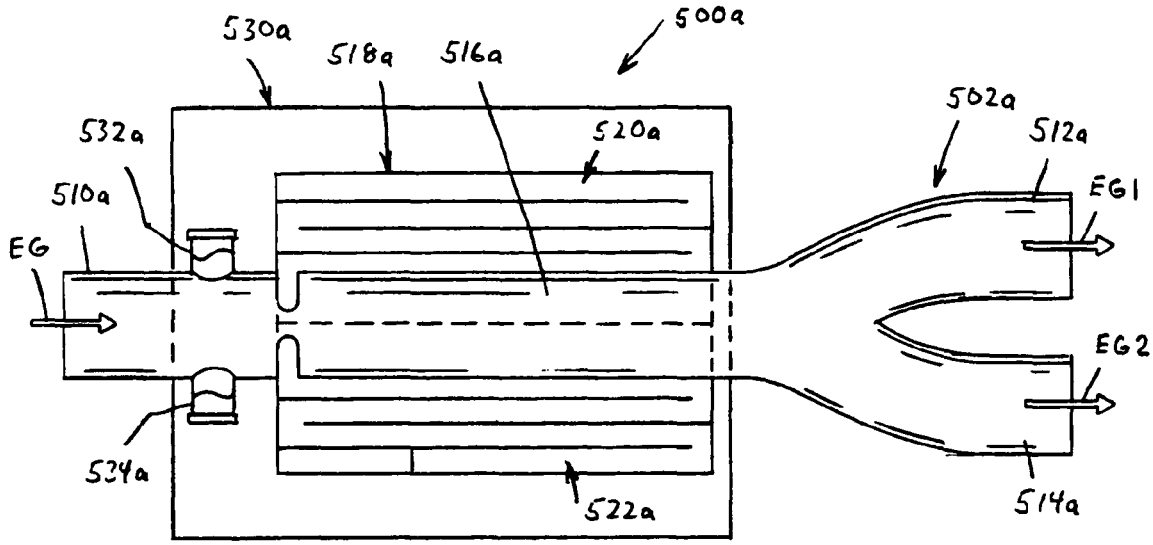
FIGS. 10*a* and 10*b* are top views of a further embodiment of the present invention including multiple outlets.
Figure 10B:
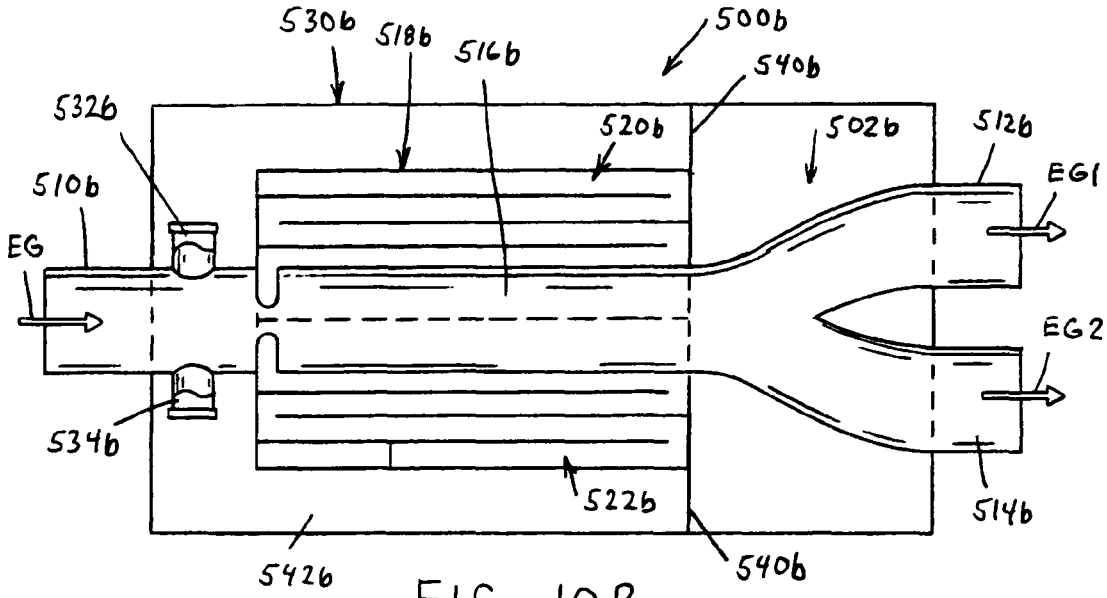

With reference to FIGS. 10*a* and 10*b*, shown are yet further embodiments of this application. In this respect a muffler according to the present invention can have anyone of a number of configurations to allow it to be utilized in a wide range of vehicles. FIGS. 10*a* and 10*b* shows mufflers 500*a* and 500*b* both having splitters to form dual outlets. More particularly, muffler 500*a* has a splitter 502*a* producing a muffler with a single inlet 510*a* and dual outlets 512*a* and 514*a*. Splitter 502*a* is an external splitter that is permanently joined to a passage 516*a* of muffler 500*a*. With respect to the remaining portions of muffler 500*a*, it can be configured according to any one of the arrangement discussed in this application including, but not limited to, having an internal sound vessel 518*a* with two sound chambers 520*a* and 522*a* spaced on either side of passage 516*a*. Muffler 500*a* can further include an outer housing 530*a* that is an outer sound chamber having connectors 532*a* and 534*a* in fluid communication with passage 516*a*. As can be appreciated, splitter 502*a* could be attached to the remaining portions at any time including during the installation of muffler 500*a* on a vehicle (not shown).

Muffler 500*b* also includes a splitter 502*b*; however, splitter 502*b* is an internal splitter positioned at least partially within a housing 530*b*. More particularly, muffler 500*b* has a splitter 502*b* producing a muffler with a single inlet 510*b* and dual outlets 512*b* and 514*b*. But, splitter 502*b* is an internal splitter that is permanently joined to a passage 516*b* of muffler 500*b* within housing 530*b*. With respect to the remaining portions of muffler 500*b*, it can be configured according to any one of the arrangement discussed in this application including, but not limited to, having an internal sound vessel 518*b* with two sound chambers 520*b* and 522*b* spaced on either side of passage 516*b*. Muffler 500*b* can further include an outer housing 530*b* that is an outer sound chamber having connectors 532*b* and 534*b* in fluid communication with passage 516*b*. Further, muffler 500*b*, or any other muffler of this application, can also include an internal barrier 540*b* that divides the inner volume of chamber 530*b* into a smaller volume. The use of internal barriers can be use for any one of a number of reasons including, but not limited to, producing a desired volume in a region 542*b* of sound chamber 530*b* to tune it to a particular frequency, or range of frequencies.

Figure 11:
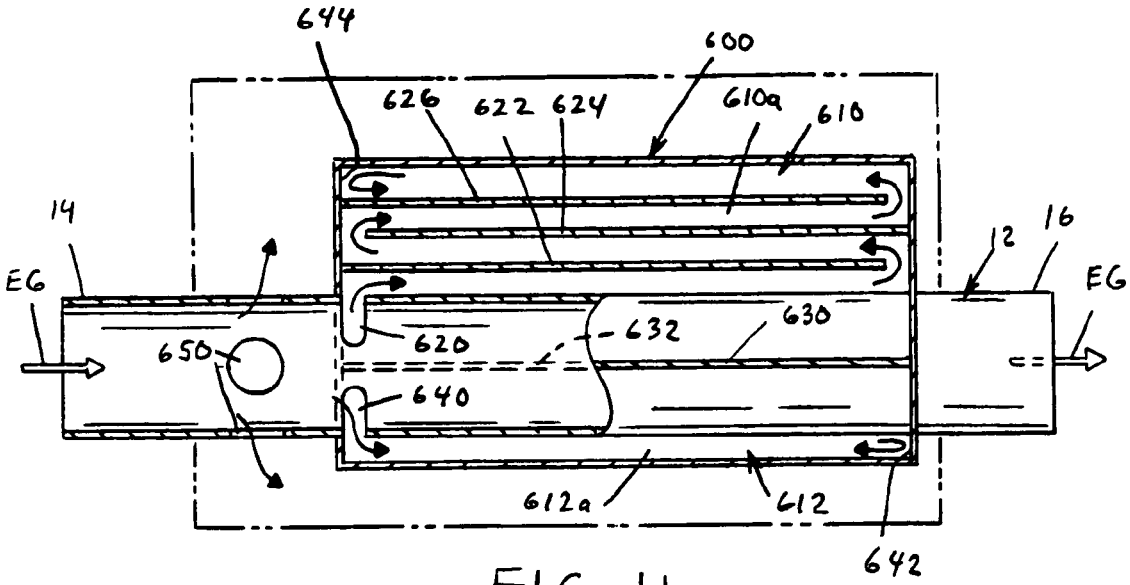
FIG. 11 is a top sectional view of yet another embodiment of the present invention including an inner vessel and both inner and outer sound chambers.

With reference to FIG. 11, an inner sound vessel 600 is shown. Sound vessel 600 includes a first sound chamber 610 and a second sound chamber 612. First sound chamber is in fluid connection with through pipe 12 via opening 620 and includes partitions 622, 624 and 626 thereby producing flow path 610*a*. Sound chamber 610 is separated from sound chamber 612 by ribs 630 and 632. Sound chamber 612 includes a slot or opening 640 for the fluid connection between the through pipe and the sound chamber. Sound chamber 612 extends between opening 640 and a stop plate 642 wherein flow passage 612*a* is much shorter than flow passage 610*a* that extends between opening 620 and stop wall 644. Through pipe 12 in this arrangement includes opening 650 for the fluid connection between the through pipe and an outer sound chamber (shown in phantom). As with other embodiments in this application, the inner sound vessel can be used with or without an outer sound chamber.

Figure 12:
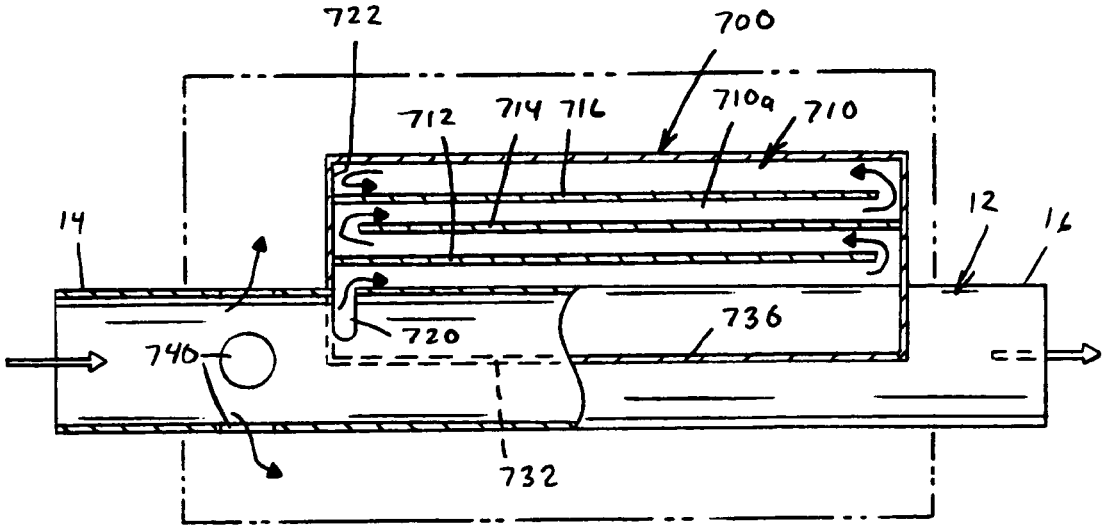
FIG. 12 is a top sectional view of another embodiment of the present invention including a single inner sound chamber along with openings to an outer chamber.

FIG. 12 shows an inner sound vessel 700 that includes a single sound chamber 710. As is discussed above, the inner sound vessel can include one or more separate and/or connected sound chambers. While it may be preferred that two inner sound chambers are utilized, one sound chamber or more than two sound chambers can be utilized in accordance with the invention of this application. Sound chamber 710 includes partitions 712, 714 and 716 which in part define sound passage 710*a* that extends between opening 720 and a stop plate 722. As with other embodiments in this application, the length of the sound passage 710*a* can be modified by using more or less partitions and/or changing the overall length of the sound vessel. In this particular embodiment, ribs 730 and 732 are utilized to help separate inner chamber and vessel 700 from the outer chamber which is not shown. This arrangement can include openings 740 for the fluid connection between the through pipe 12 and the optional outer sound chamber.

Figure 13:
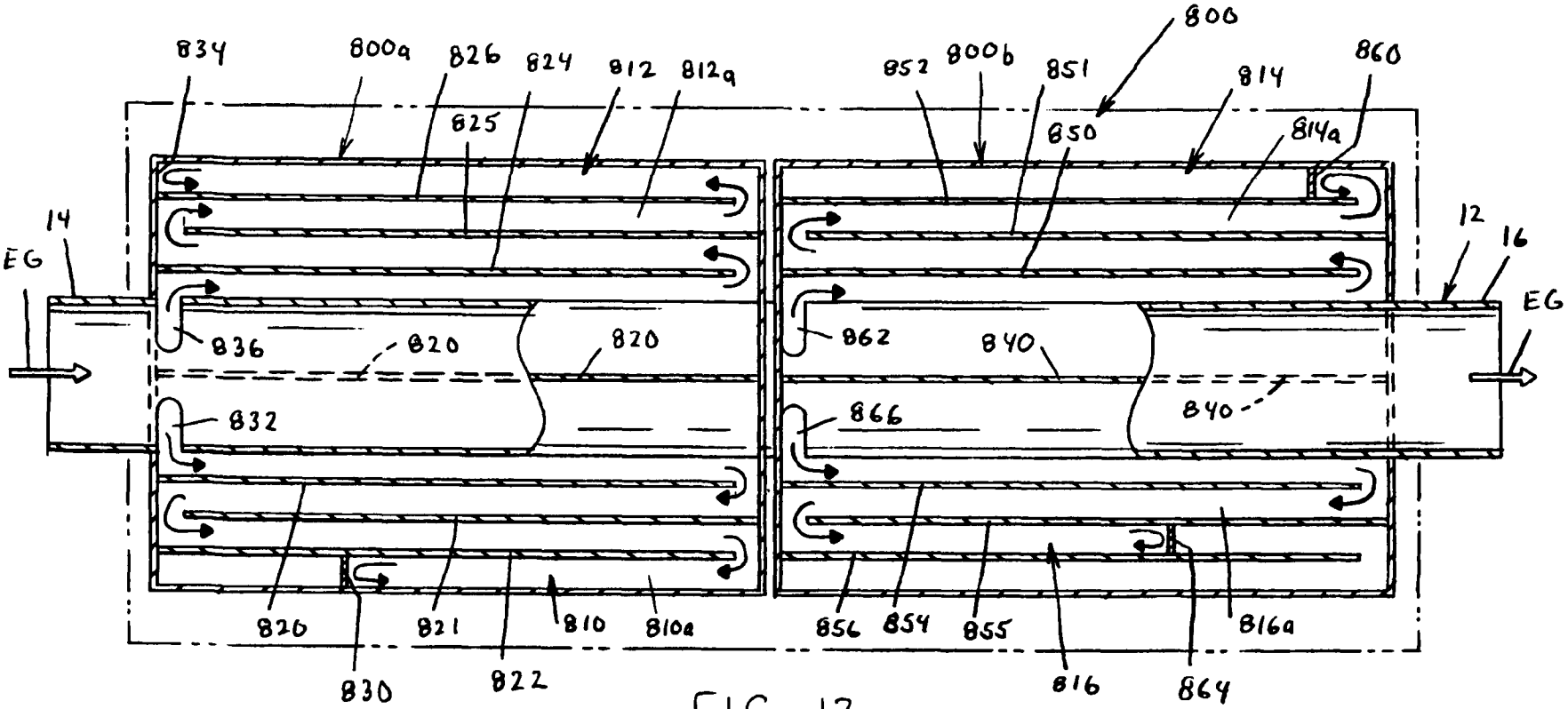
FIG. 13 is a top sectional view of yet another embodiment according to the present invention showing an inner sound vessel that includes four sound chambers.

FIG. 13 shows a sound vessel 800 that includes four sound chambers, namely sound chambers 810, 812, 814 and 816. As is discussed above, the number of sound chambers can be from 1 to as many as is needed to attenuate the desired range of frequencies. This embodiment shows four sound chambers including two pairs of axially spaced chambers on either side of through pipe 12. As with other embodiments in this application, sound vessel could be formed with an outer layer that is designed to be the outer layer of a muffler. Conversely, vessel 800 could be the inner portion of a muffler wherein a functional, or non functional outer layer (shown in phantom) is utilized. In this Figure, vessel 800 is configured for an outer layer that is not design for reactive sound deadening. Furthermore, the functional outer layer could also have connectors or inlet tube(s) joined to the through pipe or passage 12 at any position along this pipe. More particularly, vessel 800 includes two sub-vessels 800*a* and 800*b* that are shown to be separate vessels that are axial spaced along passage 12. The inlet tube(s) could be upstream of sub-vessels 800*a*, between sub-vessels 800*a* and 800*b* or downstream of sub-vessels 800*b* without detracting from the invention in this application. Yet even further, this embodiment and others in this application can include multiple tanks and multiple sets of inlet tube(s).

With reference to the shown embodiment, the sub-vessels are separate vessels adjacent one another. However, as can be appreciated, sub-vessels 800*a* and 800*b* could be formed from common outer walls with a spacer within the common outer walls to separate the two sub-vessels. Further, while two sub-vessels are shown, this application is not to be limited to two sub-vessels. In these other embodiments, the inlet tube(s) referenced above could be between any of these additional sub-vessels. Yet even further, sub vessels 800*a* and 800*b* could be a different size such as, for example, a different length. Sub vessel 800*a* includes chambers 810 and 812 that are spaced on either side of through pipe 12 and these chambers can be isolated from one another by ribs 820 wherein ribs 820 extend the length of the sub-vessel. Chamber 810 includes partitions 820-822 and chamber 812 includes partitions 824-826. These partitions, in part, form flow passages 810*a* and 812*a*, respectively. The lengths of flow paths 810*a* and 812*a* are controlled, in this embodiment, by the placement of the stop plates. More particularly, chamber 810 includes a stop plate 830 and through pipe 12 includes an opening 832 in fluid communication with flow passage 810*a* such that flow passage 810*a* extends between opening 832 and stop plate 830. Similarly, chamber 812 includes a stop plate 834 and through pipe 12 includes an opening 836 in fluid communication with flow passage 812*a* such that flow passage 812*a* extends between opening 836 and stop plate 834. In view of the placement of stop plate 830, flow path 810*a* is shorter than flow path 812*a* wherein chamber 810 will attenuate a shorter wave length than chamber 812.

Sub vessel 800*b* includes chambers 814 and 816 that are also spaced on either side of through pipe 12 and these chambers can be isolated from one another by ribs 840 wherein ribs 840 extend the length of the sub-vessel. Chamber 814 includes partitions 850-852 and chamber 816 includes partitions 854-856. These partitions, in part, form flow passages 814*a* and 816*a*, respectively. The lengths of flow paths 814*a* and 816*a* are controlled, in this embodiment, by the placement of the stop plates. More particularly, chamber 814 includes a stop plate 860 and through pipe 12 includes an opening 862 in fluid communication with flow passage 814*a* such that flow passage 814*a* extends between opening 862 and stop plate 860. Similarly, chamber 816 includes a stop plate 864 and through pipe 12 includes an opening 866 in fluid communication with flow passage 816*a* such that flow passage 816*a* extends between opening 866 and stop plate 864. In view of the placement of stop plate 864, flow path 816*a* is shorter than flow path 814*a* wherein chamber 816 will attenuate a sound wave with a shorter wave length than chamber 814. Further, flow path 814*a* is shorter than flow paths 810*a* and 812*a* wherein chamber 814 will attenuate a sound wave with a shorter wave length than chamber 810 and 812. In all, the lengths of the respective flow paths are all different such that vessel 800 will attenuate an even greater range of sound waves. As can be appreciated, the outer housing (shown in phantom) could be used to further deaden sound.

Figure 14:
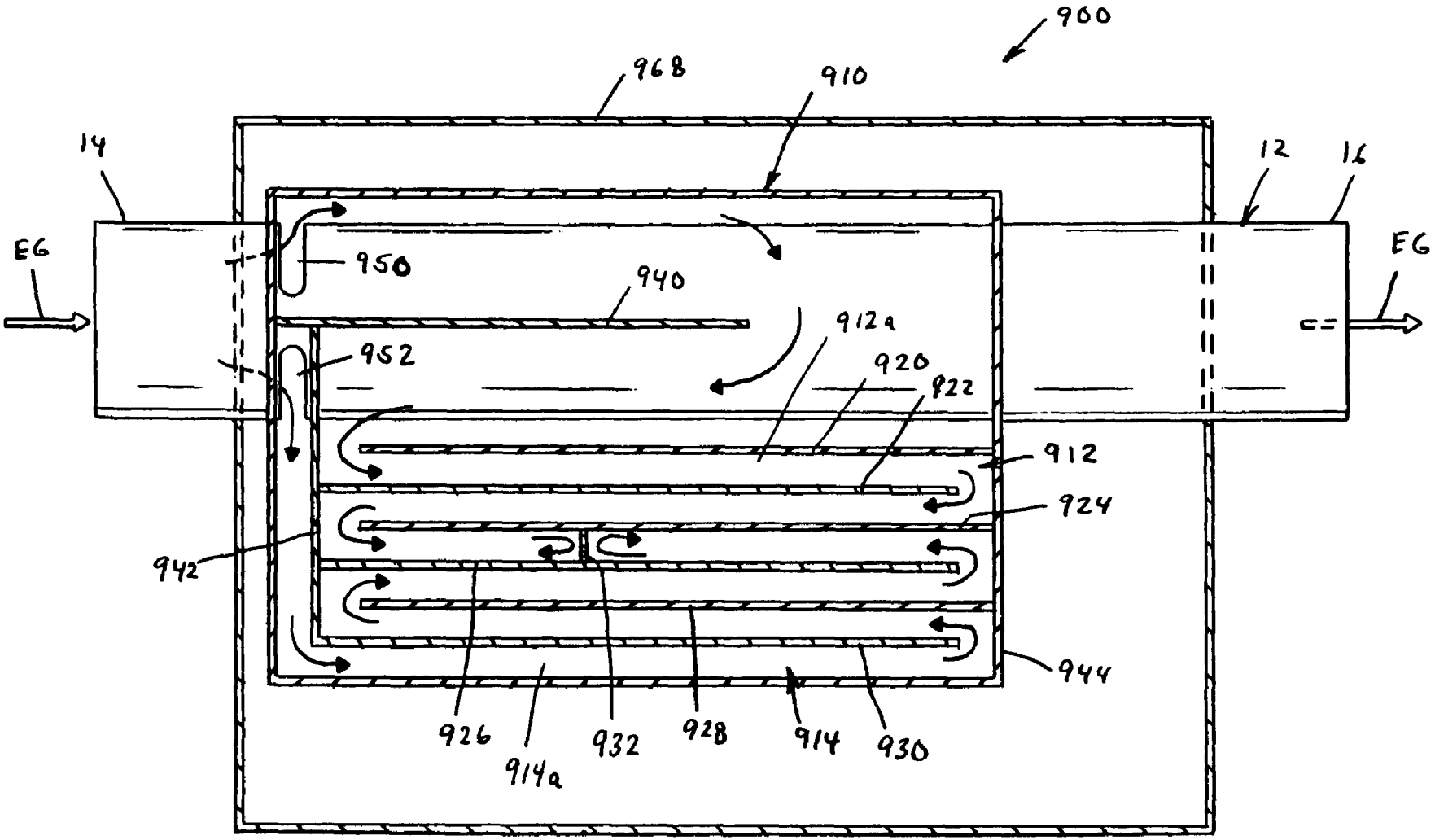
FIG. 14 is a top sectional view of yet another embodiment of the invention of this application with a cross over sound chamber.

FIG. 14 shows a muffler 900 which includes an inner sound vessel 910 having two sound chambers 912 and 914 that are on the same side of through pipe 12. In this respect, the invention of this application is not limited to inner sound vessels having only single sound chambers on each side of the through pipe. Different fluid connections can be utilized to allow multiple sound chambers on one or both sides of the through pipe which allows the muffler according to the present invention to be used in connection with an even greater range of vehicles. As is discussed above, different vehicles can have very different space limitations for the placement of the muffler system. The result of these limitations can create a situation where the through pipe must be spaced on one side of the muffler as opposed to a central placement of the through pipe. Further, many muffler systems have an offset design wherein the inlet of the through pipe is on one side of the muffler while the outlet of the through pipe is on the opposite side of the through pipe. These different restrictions can dictate the shape of the muffler wherein flexibility on the placement of the sound chambers can be the difference between the muffler fitting in a certain application and performing as needed and not selling a muffler for a particular vehicle.

In greater detail, inner vessel 910 includes partitions 920, 922, 924, 926, 928 and 930. Vessel 910 further includes a stop plate 932; however, stop plate 932 is a stop plate for both sound chambers 912 and 914. Vessel 910 further includes a top rib 940 and a similar bottom rib (not shown). In addition, vessel 910 includes an inner wall 942 inwardly spaced from vessel box 944. As is discussed in other portions of this application, while the drawings of this application show particular configurations for the outer housing and the vessel box, the invention of this application should not limited to these configurations and can include modifications to the shapes and sizes described herein without detracting from the invention of this application.

The two chamber system within vessel 910 is in fluid communication with the exhaust gas in the through pipe by way of openings 950 and 952. As with other embodiments in this application, the sizing of these openings are based on the cross-sectional area of the respective flow paths 912*a* and 914*a* such that the sound wave is allowed to freely move within the flow paths which minimizes unwanted harmonics. It has been found that an opening that is at least 70% of the cross-sectional area of flow path 12 or exhaust pipe area works best. With respect to sound chamber 912 and flow path 912*a*, waves from exhaust gas EG enters this chamber by way of opening 950 and passes between the surface of the through pipe, vessel box 944 and rib 940. Then, since ribs 940 are shortened ribs that do not extend from box wall to box wall, the exhaust gas waves are allowed to cross over through pipe 12 and engages partition 920 wherein its direction is reversed. The exhaust gas then is directed through flow path 912*a* by partitions 920, 922, 924 and 926 until it engages a stop plate 932 wherein the direction is reversed. The sound wave then retraces its path through flow path 912*a* until it re-enters through pipe 12 via opening 950. If the length of 912*a* is set correctly, the sound pulse re-entering the flow pipe will at least partially cancel a subsequent sound wave. This process produces attenuation.

With respect to sound chamber 914 and flow path 914*a*, exhaust gas waves enter sound chamber 914 via opening 952. The exhaust gas is then directed along the edge of vessel 910 by vessel box 944 and internal wall 942. When the wave reaches the corner of box 944, it is redirected along partition 930 based on the engagement between box 944 and the partition. The flow of this wave is then directed between the partitions until it reaches stop plate 932 wherein it is redirected back along the same flow path so that it can re-enter through pipe 12 and attenuate a subsequent wave.

While not shown, muffler 900 can also include an outer sound chamber. Further, as with all embodiments in this application, the muffler can include additional inner and outer sound chambers including inner chambers axially spaced from chamber 912 and 914. In this respect, a second inner vessel (not shown) could be positioned downstream of vessel 910 within outer housing 968 thereby allowing the attenuation of yet even further frequencies. Similarly, the outer housing can have more than one outer sound chamber without detracting from the invention of this application. As can be appreciated, the number of chambers and the position of the chambers are not limited and can change significantly based on the vehicle in which the device is used. Furthermore, an exhaust system according to the present invention can also include multiple muffler systems spaced from one another in the exhaust system. This particular arrangement could be used in view of space limitations or even to achieve a desired sound from the exhaust gas. Furthermore, the slots or opening to create the fluid connection between the through pipe and the respective sound chamber can have many configurations and can be positioned in different locations. In this respect, while the drawings of this application show the slots to be radially spaced from one another, they can also be axially spaced such that (for example) slots 950 could be axially spaced from slot 952 on the opposite side of inner wall 942 without detracting from the invention of this application.

FIGS. 15-20 show a particular method of fabricating the inner vessels according to the present invention. As is discussed above, these inner vessels can have many different configurations without detracting from the invention of this application. Further, the inner vessels of this application can be manufactured by any manufacturing technique known in the art. It has been found that formed and welded sheet stock material can be utilized to fabricate the inner vessel structure. As is known in the art, the materials used to fabricate this box structure can include stainless steel. It has been found that 400 Series stainless steels work particularly well for this application. However, the invention of this application is not to be limited to stainless steel and any material currently known in the art could be used and future materials could also be used without detracting from the invention of this application.

Figure 15:
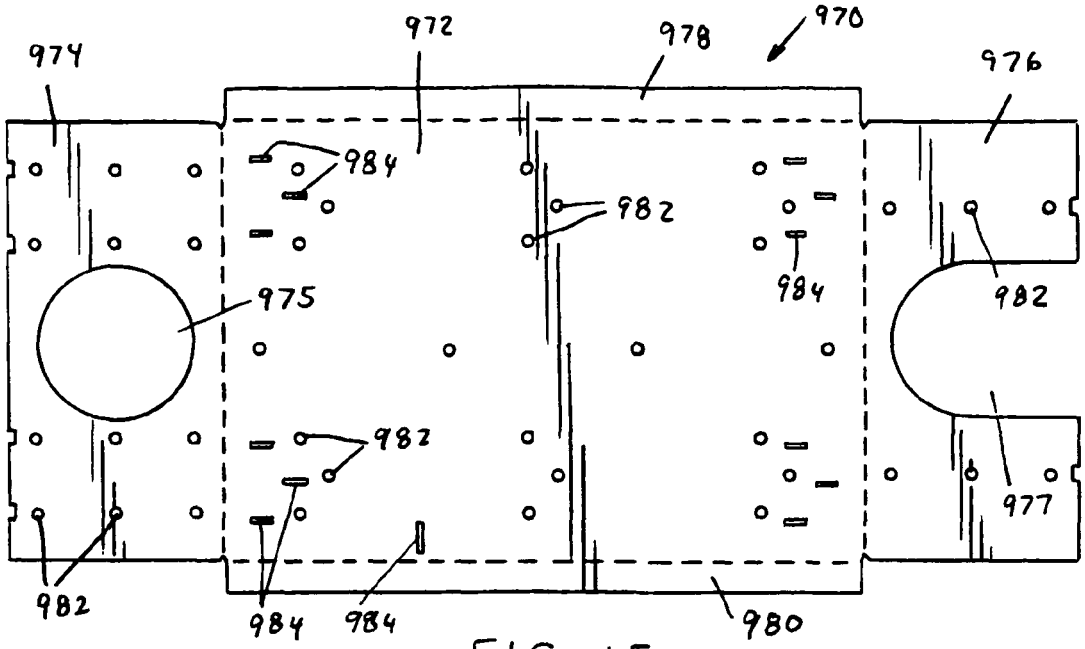
FIG. 15 is a top view of the cut sheet stock used to form the base and two sides of the inner sound vessel.
Figure 16:
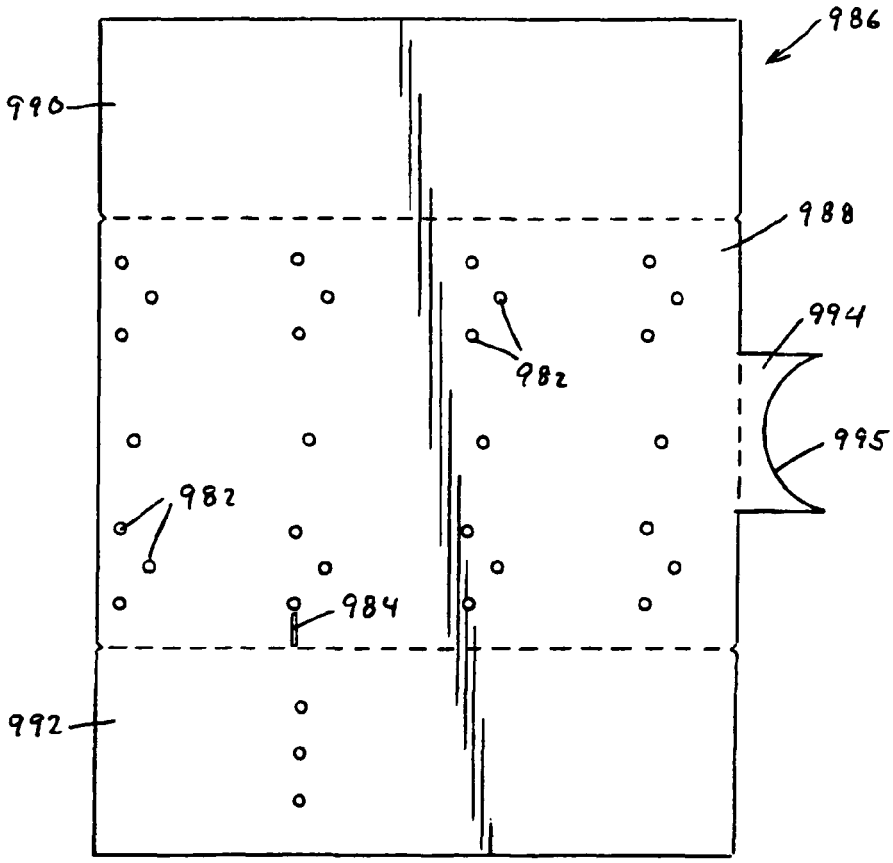
FIG. 16 is a top view of the cut sheet stock used to form the top and two sides of the inner sound vessel.

FIGS. 15-20 show six different components utilized to create a vessel such as vessel 20. FIGS. 15 and 16 show the outer box structural components before these components have been formed. In this respect, FIG. 15 shows component 970 which includes base section 972 and ends 974 and 976. End section 974 includes a through pipe opening 975 and end section 976 includes a through pipe slot 977. Component 970 further includes tabs 978, 980. In addition, this component includes a plurality of weld openings 982 and guide slots 984 that are utilized to help position the internal components within the outer box structure during manufacturing. This sheet is formed such that it is bent 90° about the dashed lines. Similarly, component 986 (FIG. 16) includes a top section 988, a side section 990 and a side section 992 along with a through pipe tab 994. Tab 994 includes a curved end portion 995 that works in connection with slot 977 of component 970 to allow through pipe 12 to extend through vessel 20 by way of opening 975 and the opening produced by slots 977 and 995.

Any technique known in the art can be utilized to produce the necessary seals between the through pipe and these openings within the vessel. Further, as is discussed above, the opening sizes in vessel 20 are dictated by the particular diameter of through pipe that is to be utilized in the exhaust system. The size of the through pipe is dictated by the internal combustion engine of the vehicle for the particular application. As with component 970, component 986 includes welding holes 982 and alignment slots 984 wherein this component is also bent 90° about the dashed lines. Components 970 and 986 are configured to be joined together to form the outer box structure of an inner vessel such as inner vessel 20.

Figure 17:
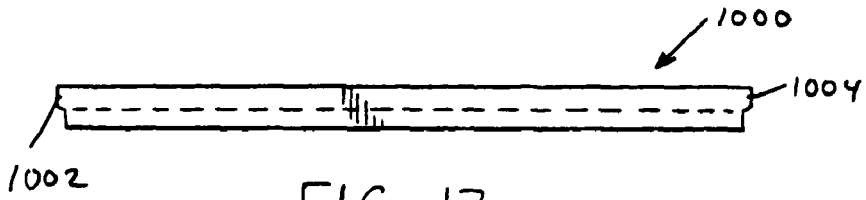
FIG. 17 is a top view of a rib used in the inner sound vessel.

FIG. 17 shows a rib 1000 extending between an end 1002 and an end 1004 that defines a rib length. In this particular vessel configuration, the length of rib 1000 corresponds with the length of base section 972 of component 970. This configuration of rib can be utilized to separate the vessel into two sound chambers spaced on either side of the through pipe.

Figure 18:
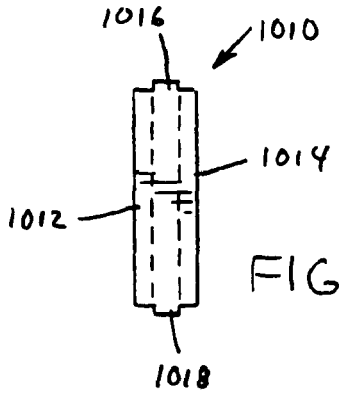
FIG. 18 is a side view of a stop plate used in the inner sound vessel.

FIG. 18 is a side view of a stop plate 1010 having side tabs 1012, 1014 along with a top tab 1016 and a bottom tab 1018. Plate 1010 can be utilized to adjust the length of a particular flow path to attenuate a desired frequency of wave form. As can be appreciated, in applications wherein the sound chambers are equally sized on either side of the through pipe, the flow path for both sound chambers would be equal if the same number of partitions were used. As a result, the sound attenuation would then be the same for both chambers. By including end plate 1010 in one of the sound chambers, the particular sound passage can be shortened to change the frequency of wave that is attenuated by that sound chamber. As with the other components, this sheet stock is formed 90° or bent about the dashed lines and end tabs 1012, 1014 can be utilized as welding tabs to secure this end plate to a particular set of partitions and for outer box. Tabs 1016 and 1018 can also be utilized to help align the end plate within the sound chamber wherein it can be positioned in the alignment slots, such as slots 984, to produce a manufacturable product that has high repeatability.

Figure 19:
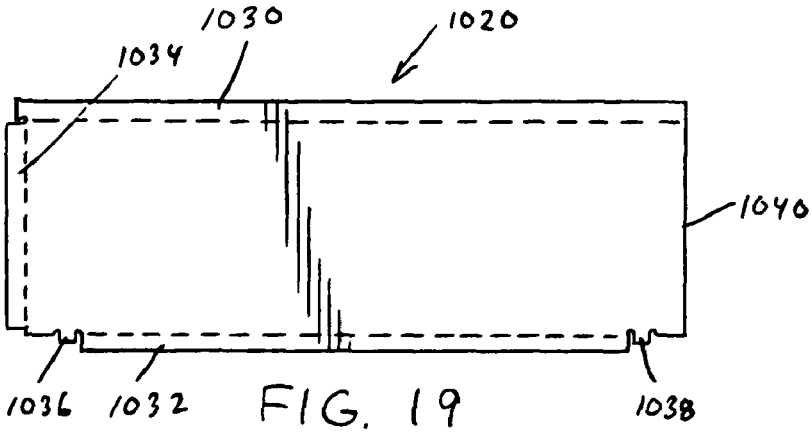
FIG. 19 is a side view of a partition used in the inner sound vessel.
Figure 20:
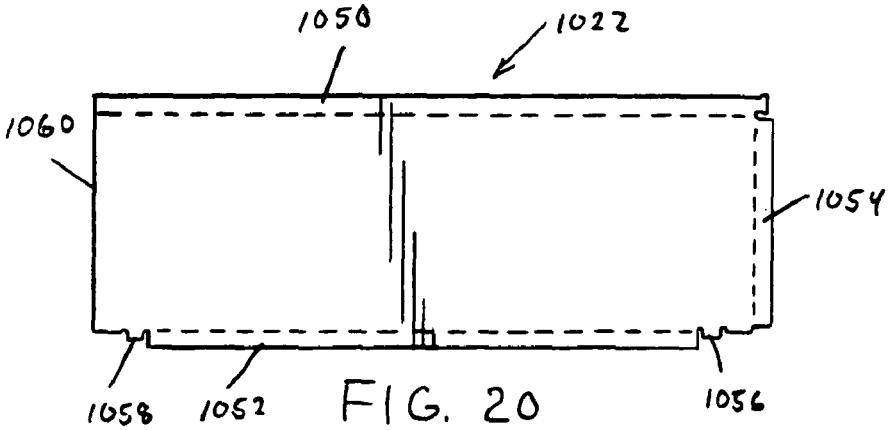
FIG. 20 is a side view of another partition used in the inner sound vessel; and, FIG. 21 is a top sectional view of yet a further embodiment of the invention of this application with a further cross over style sound chamber.

FIGS. 19 and 20 show partitions 1020 and 1022. These partitions are similarly configured and are used in combination with one another to extend the length of the flow path of the sound chamber. Partition 1020 has a top tab 1030, a bottom tab 1032 and a front tab 1034 along with alignment tabs 1036, 1038. Partition 1020 is formed about the dashed lines and is placed within vessel 20 such that tab 1034 is attached to front section 974 of component 970. The length of partition 1030 produces a gap between a rear edge 1040 of partition 1030 and rear section 976 of component 970. For example, partition 50 of chamber 20 could be produced by partition 1030.

Partition 1022 has top tab 1050, bottom tab 1052 and rear tab 1054 along with alignment tabs 1056, 1058. Partition 1020 is formed about the dashed line and is placed within vessel 20 such that tab 1054 is attached to rear section 976 of component 970. The length of partition 1050 produces a gap between a front edge 1060 of partition 1050 and front section 974 of component 970. For example, partition 52 of chamber 20 could be formed by partition 1022.

As can be appreciated, the number of components including the number of partitions is based on the length of the flow path necessary to attenuate the desired frequency and the length of the vessel. As the wave length increases, the flow path also needs to increase to produce attenuation of the desire sound. Again, the materials utilized to make the components in FIGS. 15-20 and in the other Figures in this application can be any materials known in the art including, but not limited to, the 400 Series stainless steel discussed above. Further, these components are joined to one another utilizing any known manufacturing techniques in the art including welding the components by conventional welding techniques. Openings 982 can be utilized for the welding process according to techniques known in the art.

Figure 21:
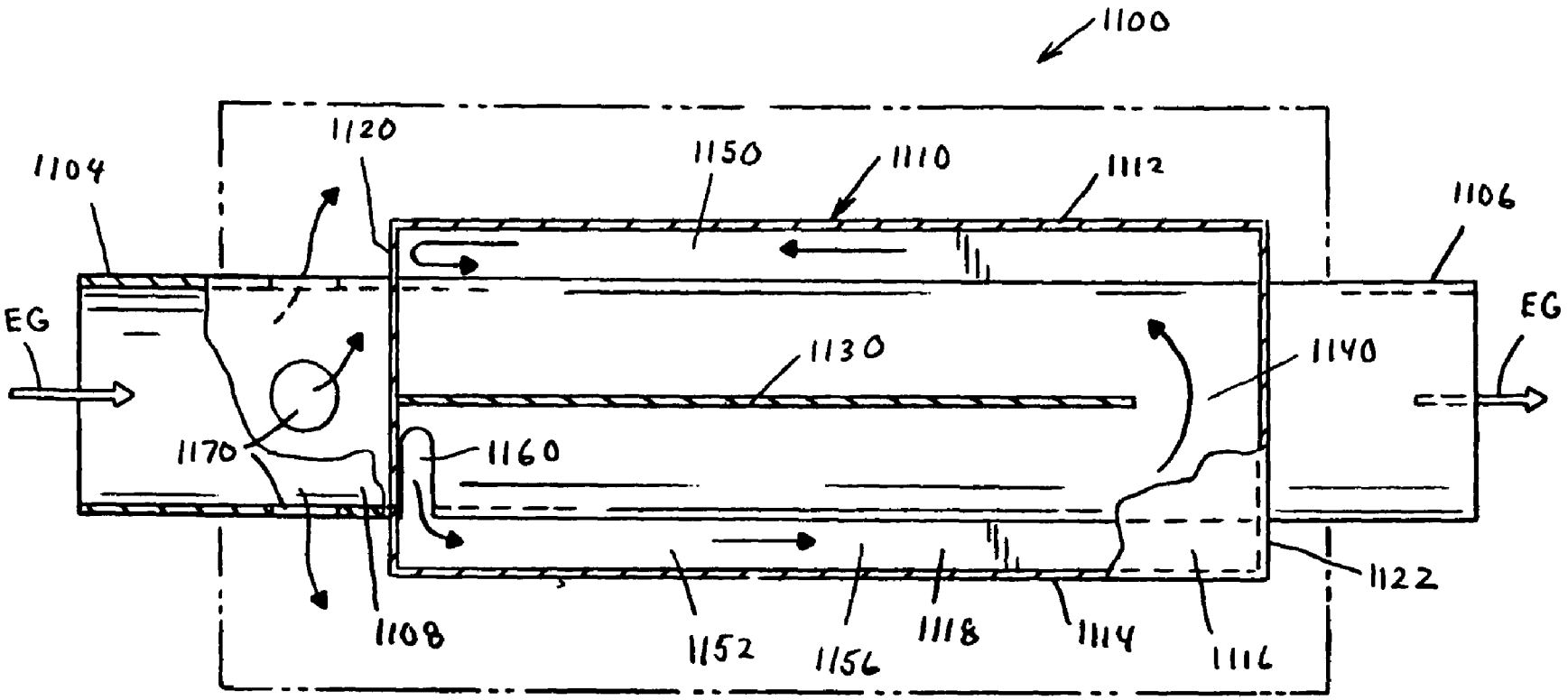

FIG. 21 shows a muffler 1100 which includes an inner sound vessel 1110 having a single sound chamber. In this respect, muffler 1100 includes an inlet 1104 and an outlet 1106 connected by a passage 1108 extending through inner sound vessel 1110. Inner sound vessel 1110 of muffler 1100 includes side walls 1112, 1114 that are parallel to one another; a top wall 1116 and a bottom wall 1118 that are parallel to one another and end plates 1120 and 1122 wherein end plates are joined on either end of walls 1112, 1114, 1116 and 1118. Vessel 1110 further includes a top rib 1130 and a similar bottom rib (not shown). Top and bottom ribs 1130 extend from end plate 1120 toward end plate 1122; however, the ribs are shorter than walls 1112, 1114, 1116 and 1118 such that gaps 1140 are formed between passage or through pipe 1108 top wall 1116, bottom wall 1118 and end plate 1122. Further, ribs 1130 form passages 1150 and 1152 on either side of passage 1108 that are in fluid communication with each other based on gaps 1140 thereby producing a single inner flow path 1156.

Flow path 1156 of inner vessel 1110 is in fluid communication with the exhaust gas EG in through pipe 1108 by way of an opening 1160 in passage 1152. As with other embodiments in this application, the sizing of these openings are based on the cross-sectional area of the respective flow paths such that the sound wave is allowed to freely move within the flow paths which minimizes unwanted harmonics. As the sound wave enters through opening 1160, it is directed down passage 1152 toward end plate 1122. Then, since ribs 1130 are shorter than walls 1112, 1114, 1116 and 1118, the sound waves are directed through gaps 1140, around passage 1108 and toward passage 1150. The exhaust gases are then directed down path 1150 back toward end plate 1120 until it engages end plate 1120 and is then, redirected back along the same path to until it again reaches opening 1160 and is reintroduced into passage 1108 to cancel a subsequent wave in the passage as is discussed above. As can be appreciated, this particular embodiment produces a longer, but narrower muffler configuration. This particular embodiment allows the muffler to be used in arrangement including, but not limited to, a side-pipe arrangements. As can also be appreciated, walls 1112, 1114, 1116 and 1118 have a common length; however, the walls do not need to have a common width wherein walls 1112 and 1114 could be narrower than wall 1116 and 1118 such that end plates 1120 and 1122 are rectangular.

Muffler 1100 can also include an outer sound chamber (shown in phantom) in fluid connection with the exhaust gasses EG by way of openings 1170 in passage 1108. Further, as with all embodiments in this application, the muffler can include additional inner and outer sound chambers including inner chambers axially spaced from the inner vessel 1110.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Further, combinations of the embodiments describe above, including their equivalence, can be made in accordance with the invention of this application. Accordingly, it is to be distinctly understood that the foregoing descriptive matter is to be interpreted merely as illustrative of the invention and not as a limitation. Furthermore, the reference to height and width and other common terms throughout this application is only in relation to traditional muffler configurations and for the simplicity of disclosure; it should in not be interpreted as being limiting to the traditional definitions of these words.

Having thus described the invention, it is so claimed:

1. An exhaust muffler for reducing the sounds associated with pressure waves of combustion gases exhausted from an internal combustion engine through an exhaust pipe, the pressure waves being a plurality of different pressure waves each having an amplitude and a frequency, the pressure waves having at least one objectionable wave having an objectionable amplitude and an objectionable frequency, said muffler comprising: mounting hardware to secure said exhaust muffler to an associated vehicle in a mounted condition such that in said mounted condition said muffler has a top, a bottom and opposing sides, said exhaust muffler further including an elongated fluid passage extending between a muffler inlet and a muffler outlet such that said muffler outlet is in fluid communication with said inlet and defines a muffler length, said muffler inlet being connectable to an end of an associated exhaust pipe of the associated vehicle and having a cross-sectional area similar to the exhaust pipe such that said passage is in an generally unrestricted fluid connection with gases exhausted from an associated engine such that the associated pressure waves freely enter said passage and said outlet being connectable with the atmosphere, said passage extending about a passage axis and said axis defining a generally vertical central plane when in said mounted condition dividing said passage into a first side region and a second side region on either side of said central plane and circumferentially spaced from one another; said first side region having a first radial extent defined as a portion of said passage in said first side region furthest spaced from said central plane, said second side region having a second radial extent defined as a portion of said passage in said second side region furthest spaced from said central plane, said first and second radial extents generally being opposite to one another and generally being horizontally spaced from one another when in said mounted condition, a sound attenuation opening in said passage for receiving and transmitting the at least one objectionable wave into a side attenuation sound chamber, said side sound chamber extending horizontally from said central plane when in said mounted condition and having a flow path with a set length based on the objectionable frequency of the objectionable wave such that when the sound pulse exits said sound chamber the sound pulse reduces the objectionable amplitude of a subsequent objectionable wave, said sound chamber having a length less than said muffler length, said exhaust muffler further including an outer housing extending about said side sound chamber and said passage forming a void therebetween said sound chamber and said outer housing, said muffler further including at least one end plate joining said outer housing to said passage.

2. The exhaust muffler according to claim 1, wherein said set length of said flow path is greater than said muffler length, said side attenuation sound chamber collectively forming a sound vessel and said sound vessel being generally rectangular in cross-sectional configuration and extending from said central plane, said side chamber further including at least one partition within said vessel, each of said at least one partition being spaced radially outwardly of said first radial extent and extending in a single partition plane parallel to said central plane, said each partition having a partition length shorter than said muffler length such that said flow path passes on both side of said partition plane.

3. The exhaust muffler according to claim 2, wherein said sound vessel has a length parallel to said elongated passage that is generally equal to said sound chamber length, said at least one partition forming fluidly connected flow path sections which together form said flow path having said length, said flow path sections including a first flow path section formed on one side by said elongated fluid passage and on the other side by said first partition.

4. The exhaust muffler according to claim 3, wherein said elongated fluid passage has a cross-sectional area and said flow path has a cross-sectional area, said flow path cross-sectional area being at least 70% of said passage area.

5. The exhaust muffler according to claim 4, wherein said first flow section has a greater cross-sectional areas than the remaining said flow path sections.

6. The exhaust muffler according to claim 1, wherein said flow path has a cross-sectional area, said flow path cross-sectional area being at least 70% of said passage area.

7. The exhaust muffler according to claim 6, wherein said elongated passage has a vertically extending passage height and said sound chamber has a chamber height, said chamber height being greater than said passage height.

8. The exhaust muffler according to claim 1, wherein said flow path has a cross-sectional area and a first portion of said flow path cross-sectional area being greater than said passage area and a second portion of said flow path cross-sectional area being generally equal to said passage area.

9. The exhaust muffler according to claim 8, wherein said sound attenuation opening is in said first portion.

10. The exhaust muffler according to claim 1, wherein said elongated passage has a vertically extending passage height and said sound chamber has a chamber height, said chamber height being greater than said passage height.

11. The exhaust muffler according to claim 1, wherein said sound attenuation opening is a first opening in said passage and said passage including a second opening spaced from said first opening, said muffler further including an outer sound chamber formed between said side attenuation sound chamber and said outer housing, said second passage opening fluidly connecting said passage to said out chamber, said outer sound chamber being a dissipation sound chamber.

12. The exhaust muffler according to claim 1, wherein the associated at least one objectionable wave is a first objectionable wave having a first objectionable amplitude and a first objectionable frequency and the pressure waves including other objectionable waves including a second objectionable wave having a second objectionable amplitude and a second objectionable frequency, said sound attenuation opening being a first sound attenuation opening and said side attenuation sound chamber being a first attenuation sound chamber with a first flow path length extending from said first side; said muffler further including a second sound attenuation opening spaced from said first opening and a second side attenuation sound chamber having a second flow path in fluid connection with said second opening, said second sound chamber extending horizontally on the opposite side of said central plane from said second side region and a substantial portion of said flow path being radially outwardly spaced from said second radial extent, said first and second flow paths having similar cross-sectional areas, but lengths that are unequal.

13. The exhaust muffler according to claim 12, wherein said first and second side attenuation sound chambers form an inner sound vessel, said inner sound vessel having a generally rectangular cross-sectional configuration with opposing planar side panels vertically parallel to said central plane and opposing planar top and bottom panels extending between said side panels and transverse to said central plane, said side panels defining a vessel height and said top and bottom panels defining a vessel width transverse to said central plane, said width being greater than said height, said passage further including a passage height and said vessel height being only slightly larger than said passage height, said first and second side attenuation chambers being encapsulated by said outer housing and said at least one end plate.

14. The exhaust muffler according to claim 1, wherein said elongated fluid passage has two outlets.

15. The exhaust muffler according to claim 1, wherein said flow path has a first portion adjacent said elongated fluid passage and said first portion being partially formed by a passage wall of said elongated fluid passage, said flow path further including a second portion and said second portion having a rectangular cross-sectional configuration.

16. The exhaust muffler according to claim 15, wherein said first portion includes a crescent shape and has a cross-sectional area greater than said elongated fluid passage, said flow path further including a second portion and said second portion having a rectangular cross-sectional configuration and a cross-sectional area generally equal to said elongated fluid passage.

17. The exhaust muffler according to claim 15, wherein said mounting hardware includes clamps securable to said elongated fluid passage.

18. The exhaust muffler according to claim 1, wherein said flow path includes a crossover such that said flow path crosses said passage from said first side region to said second side region.

19. The exhaust muffler according to claim 1, wherein muffler has an overall height and said overall height is less than 5 inches.

20. The exhaust muffler according to claim 2, wherein each of said at least one partition includes a top and a bottom flange.

21. The exhaust muffler according to claim 2, wherein each of said at least one partition is generally dimensionally equal.

22. The exhaust muffler according to claim 1, wherein said mounting hardware includes support form the associated exhaust pipe.

23. An exhaust muffler for reducing the sounds associated with pressure or sound waves of combustion gases exhausted from an internal combustion engine through an exhaust pipe, the pressure waves being a plurality of different pressure waves each having an amplitude and a frequency, the pressure waves having at least one objectionable wave having an objectionable amplitude and an objectionable frequency, said muffler comprising: mounting hardware to secure said exhaust muffler to an associated vehicle in a mounted condition such that in said mounted condition said muffler has a top, a bottom and opposing sides, said exhaust muffler further including an elongated fluid passage extending between a muffler inlet and a muffler outlet such that said muffler outlet is in fluid communication with said inlet and defines a muffler length, said muffler inlet being connectable to an end of an associated exhaust pipe of the associated vehicle and having a cross-sectional area similar to the exhaust pipe such that said passage is in an unrestricted fluid connection with gases exhausted from an associated engine such that the associated pressure waves freely enter said passage and said outlet being connectable with the atmosphere, said passage having a passage cross-sectional area and being formed by a passage wall having four quadrants circumferentially spaced about a passage axis, said four quadrants being separated by a top extent, a right extent, a bottom extent and a left extent, said top and bottom extent defining a central plane, said muffler further including a horizontally extending sound vessel being closed off by said passage wall and a plurality of panels, said plurality of panels including a planar top panel closely spaced to said top extent and a planar bottom panel closing spaced to said bottom extent and that is parallel to said top panel, a planar side panel and end panels joining said top and bottom panels and said passage wall being joined to said top and bottom panels in said central plane forming said closed sound vessel, said vessel being fluidly connected to said elongated fluid passage by a sound attenuation opening in said passage wall thereby directing the pressure waves into a sound attenuation chamber formed by said sound vessel, said sound attenuation chamber having a flow path with a flow path length based on the objectionable frequency of the objectionable wave, a substantial portion of said flow path being spaced radially outwardly of one of said left and right extents, said flow path being lengthened by a first planar partition shorter than said side panel wherein said flow path passes on both a first side and a second side of said first partition, said first side partially defining a first flow path section and said second side partially defining a second flow path section, said first flow path section being further defined by said passage wall, said flow path having a flow path cross-sectional area and said flow path cross-sectional area being at least 70% of said passage area, said exhaust muffler further including an outer housing spaced from said sound vessel and space from said passage forming a void between said sound vessel and said outer housing, said muffler further including at least one end plate joining said outer housing to said passage wall.

24. The exhaust muffler according to claim 23, wherein at least one of said top and bottom panels is joined to said passage wall by a single rib extending therebetween, said rib forming a portion of said flow path.

25. The exhaust muffler according to claim 24, wherein said rib has a rib height and said elongated fluid passage has a diameter, said rib height being less than half of said passage diameter.

26. The exhaust muffler according to claim 23, wherein said passage being joined to said top and bottom panel is joined by a first rib extending from said top extent to said top panel and a second rib extending between said bottom extent and said bottom panel.

27. The exhaust muffler according to claim 26, wherein said first and second ribs have a rib height and said elongated fluid passage has a diameter, said rib heights being less than half of said passage diameter.

28. The exhaust muffler according to claim 23, wherein said elongated passage has a vertically extending passage height and said sound vessel has a vessel height, said vessel height being greater than said passage height.

29. The exhaust muffler according to claim 23, wherein said cross-sectional area of said first portion is greater than said passage area and said cross-sectional area of said second portion is generally equal to said passage area.

30. The exhaust muffler according to claim 23, wherein said sound attenuation opening is a first opening in said passage and said passage including a second opening spaced from said first opening, said muffler further including an outer sound chamber formed between in said void, said second passage opening fluidly connecting said passage to said out chamber, said outer sound chamber being a dissipation sound chamber.

31. The exhaust muffler according to claim 23, wherein said flow path includes a crossover such that said flow path crosses said passage from said first side region to said second side region.

32. The exhaust muffler according to claim 23, wherein said mounting hardware includes support form the associated exhaust pipe.

* * * * *